US012534967B2

(12) United States Patent
McBeth

(10) Patent No.: US 12,534,967 B2
(45) Date of Patent: Jan. 27, 2026

(54) SYSTEM AND METHOD FOR SUPPORTING RISERS FROM FLOATING VESSEL

(71) Applicant: National Coupling Company, Inc., Stafford, TX (US)

(72) Inventor: Russell Eric McBeth, The Woodlands, TX (US)

(73) Assignee: National Coupling Company, Inc., Stafford, TX (US)

( * ) Notice: Subject to any disclaimer, the term of this patent is extended or adjusted under 35 U.S.C. 154(b) by 0 days.

(21) Appl. No.: 18/923,469

(22) Filed: Oct. 22, 2024

(65) Prior Publication Data

US 2025/0188807 A1 Jun. 12, 2025

Related U.S. Application Data

(60) Provisional application No. 63/607,487, filed on Dec. 7, 2023.

(51) Int. Cl.
*E21B 17/01* (2006.01)
*B63B 27/24* (2006.01)
(Continued)

(52) U.S. Cl.
CPC ..... *E21B 19/07* (2013.01); *B63B 27/24* (2013.01); *B63B 27/34* (2013.01)

(58) Field of Classification Search
CPC ..... E21B 19/07; E21B 29/12; E21B 17/01; E21B 17/015; B63B 27/24; B63B 27/34
(Continued)

(56) References Cited

U.S. PATENT DOCUMENTS 5,947,642 A * 9/1999 Teixeira ..... F16L 37/096 405/195.1
6,536,527 B2 * 3/2003 Munk ..... E21B 43/0107 166/341
(Continued)

FOREIGN PATENT DOCUMENTS

BR 102018011452 A2 12/2019
BR 1020210173440 A2 3/2023
(Continued)

OTHER PUBLICATIONS

Search Report in GB2417906.1 dated Apr. 23, 2025, 1-pgs.
(Continued)

*Primary Examiner* — Nicole Coy
*Assistant Examiner* — Douglas S Wood
(74) *Attorney, Agent, or Firm* — Cabello Hall Zinda, PLLC

(57) ABSTRACT

A system facilitates communication between a vessel and a subsea environment using a tubular component. The system includes a receiver and a connector. The receiver, mounted on the vessel, features a bore with an engagement shoulder and latch profile. The connector, attached to the tubular component, consists of a latch mechanism, trigger mechanism, wedge mechanism, and lock mechanism. The latch can move from a retracted to an extended position, allowing it to engage with the latch profile in the receiver's bore. The trigger, connected to the latch, activates when it contacts the engagement shoulder, moving the latch into its extended position. The wedge, coupled to the latch, wedges against the bore when the latch is extended. Finally, the lock mechanism secures the wedge in place by moving from an unlocked to a locked position, ensuring the wedge remains fixed against the bore of the receiver.

34 Claims, 19 Drawing Sheets

(51) Int. Cl.
*B63B 27/34* (2006.01)
*E21B 19/07* (2006.01)

(58) Field of Classification Search
USPC ..... 166/359, 345
See application file for complete search history.

(56) References Cited

U.S. PATENT DOCUMENTS

| | | | | |
|---|---|---|---|---|
| 8,016,520 | B2 * | 9/2011 | Dybvik | B63B 27/24 166/359 |
| 8,939,214 | B2 * | 1/2015 | Litherland | E21B 43/0107 166/346 |
| 9,482,061 | B2 * | 11/2016 | Latimer | E21B 17/085 |
| 10,287,859 | B2 * | 5/2019 | Preston | E21B 17/017 |
| 10,597,952 | B2 | 3/2020 | Otten et al. | |
| 10,994,324 | B2 | 5/2021 | Huber | |
| 11,613,934 | B2 * | 3/2023 | Pinho Dos Reis | E21B 17/085 166/367 |
| 2002/0009336 | A1 | 1/2002 | Munk et al. | |
| 2007/0056741 | A1 | 3/2007 | Finn et al. | |
| 2007/0267197 | A1 | 11/2007 | Pallini et al. | |
| 2008/0007056 | A1 | 1/2008 | Beesley | |
| 2008/0087435 | A1 | 4/2008 | Reddy | |
| 2015/0337607 | A1 | 11/2015 | Latimer et al. | |
| 2018/0313172 | A1 | 11/2018 | Smits et al. | |
| 2022/0186570 | A1 | 6/2022 | De Mello et al. | |

FOREIGN PATENT DOCUMENTS

| | | | |
|---|---|---|---|
| EP | 4001672 | A1 | 5/2022 |
| GB | 2508919 | A | 6/2014 |
| WO | 2017034409 | A1 | 3/2017 |
| WO | 2019232605 | A1 | 12/2019 |
| WO | 2021048592 | A1 | 3/2021 |
| WO | 2022188935 | A1 | 9/2022 |
| WO | 2023028680 | A1 | 3/2023 |

OTHER PUBLICATIONS

Balltec, "Ballteck BendLOK(TM) Diverless Bend Stiffener Connector," obtained from https://asrental.sg/products/balltec/surf-solutions/balltec-bendlok-diverless-bend-stiffener-connector/ on Oct. 16, 2024, copyright 2019-2023, 5-pgs.

Balmoral Comtec, "Balmoral bend stiffener connector," webpage obtained from https://www.balmoraloffshore.com/solutions/protection/bend-stiffener-connector on Oct. 16, 2024, undated, 5-pgs.

FES International, "Diverless Bend Stiffener Connector," Data sheet, obtained from https://www.fesinternational.com/fluid-transfer-products/diverless-bend-stiffener-connector-dbsc/ on Oct. 16, 2022, undated, 2-pgs.

FES International, "Diverless Bend Stiffener Connectors," Presentation obtained from https://www.fesinternational.com/fluid-transfer-products/diverless-bend-stiffener-connector-dbsc/ on Oct. 16, 2024, undated, 25-pgs.

Petrobras, "Control and Monitoring System for Riser Supports," Technical Specification, dated Apr. 8, 2021, 27-pgs.

Petrobras, "Control and Monitoring System for Riser Supports," Technical Specification, revision E, dated Oct. 28, 2022, 27-pgs.

Petrobras, "FPSO Structures and Facilities for Riser System," Technical Specification, Revision A, dated Dec. 12, 2022, 55-pgs.

Petrobras, "Unified Diverless Support Tube Factory Acceptance Test Procedure," Technical Specification Revision 0, dated Mar. 19, 2021, 36-pgs.

Petrobras, "Unified Diverless Support Tube," Technical Specification, Revision 0, dated Mar. 8, 2021, 41-pgs.

Petrobras, "Wear Bushing for Riser Unified Diverless Support Tubes," Technical Specification Revision ), dated Mar. 9, 2021, 12-pgs.

* cited by examiner

SYSTEM AND METHOD FOR SUPPORTING RISERS FROM FLOATING VESSEL

CROSS-REFERENCE TO RELATED APPLICATIONS

This application claims the benefit of U.S. Provisional Appl. No. 63/607,487 filed Dec. 7, 2023, which is incorporated herein by reference in its entirety.

BACKGROUND OF THE DISCLOSURE

Risers and riser support systems have been used on structures and vessels, such as floating production storage and offloading (FPSO) units. For example, U.S. Pat. No. 5,947,642 discloses an apparatus for connecting an underwater flexible riser to a structure on the surface. US 2007/0056741 discloses an apparatus for supporting a steel catenary riser from a floating structure. WO 2017/034409 discloses a top locking system for a riser tube on a floating vessel. WO 2019/232605 discloses a system for coupling between a bend stiffener and a bell mouth. Some systems have used an arrangement of double balconies. Some examples of these arrangements are disclosed in WO 2021/048592 and WO 2023/028680.

Some existing systems have complicated arrangements, cannot be operated without divers, or require hydraulic or other forms of actuation that may be subject to failure. Although existing systems may be effective, operators are always seeking ways to improve and simplify the structures and operations involved in supporting risers and other tubular components from a floating vessel. To that end, the subject matter of the present disclosure is directed to overcoming, or at least reducing the effects of, one or more of problems associated with existing systems.

SUMMARY OF THE DISCLOSURE

A system disclosed herein supports a tubular component used to communicate between a vessel and a subsea environment. The system comprises a receiver and a connector. The receiver is configured to be supported on the vessel. The receiver defines a receiver bore therethrough, and the receiver bore defines an engagement shoulder and defines a latch profile therein. The connector is disposed on the tubular component and is insertable in the receiver bore. In general, the tubular component can be an umbilical, a flexible pipe, a rigid pipe, or a power cable. The connector can further comprise a bend limiter extending from an end of the connector.

In a first configuration, the connector has a latch, a trigger, and an anchor. The latch is disposed on the connector and is mechanically movable with a first mechanical movement at least from a retracted condition to an extended condition on the connector. The latch in the extended condition is configured to latch in the latch profile in the receiver bore.

The trigger is disposed on the connector and is operatively coupled to the latch. The trigger is mechanically triggered in response to engagement with the engagement shoulder in the receiver bore. When triggered, the trigger is configured to initiate the first mechanical movement of the latch from the retracted condition to the extended condition.

The anchor is disposed on the connector and is operatively coupled to the latch. The anchor is configured to mechanically engage against the receiver bore in response to the first mechanical movement of the latch to the extended condition.

In general, the receiver bore can define an inner stop shoulder therein, and the latch profile can be disposed between the engagement shoulder and the inner stop shoulder. A first external stop shoulder of the connector can be configured to engage against the inner stop shoulder. Also, a second external stop shoulder on the connector can be configured to engage against the engagement shoulder of the receiver.

In a second configuration, the connector can further comprise a lock disposed on the connector. The lock can be operatively coupled to the anchor and can be mechanically movable with a second mechanical movement at least from an unlocked condition to a locked condition. The lock in the locked condition can be configured to lock the anchor against the receiver bore.

For this second configuration, the connector can further comprise a slip disposed on the connector between the lock and the anchor. The slip can be configured to grip between the lock and the anchor in response to the lock is in the locked condition.

In a third configuration, the connector can define a first side opening. The latch can comprise a sleeve, a first biasing element, and at least one dog. The sleeve can be axially moveable at least from a first axial position to a second axial position on the connector. The first biasing element can bias the sleeve from the first axial position toward the second axial position. The at least one dog can be disposed in the first side opening of the connector and can be laterally moveable at least from a retracted position in conjunction with the sleeve in the first axial position to an extended position in conjunction with the sleeve in the second axial position. In one example, the at least one dog can comprise a plurality of bearings disposed in respective ones of the first side opening of the connector arranged about a circumference of the connector.

In this third configuration, the connector can define a second side opening. The trigger can comprise a pin disposed in the second side opening of the connector and can be biased from a released condition to an engaged condition. The pin in the engaged condition can be engaged with the sleeve of the latch and can hold the latch in the first axial position. The pin in the engaged condition can be configured to engage the engagement shoulder of the receiver bore and can be moveable to the released condition. The pin in the released condition can release the sleeve to move toward the second axial position.

Further in this third configuration, the connector can define a third side opening, and the anchor can comprise an activation wedge, a second biasing element, and an engagement wedge. The activation wedge can be axially moveable at least from an inactive position to an active position on the connector. The second biasing element can bias the activation wedge from the inactive position toward the active position. The engagement wedge can be disposed in the third side opening of the connector and can be laterally moveable from an unwedged position to a wedged position. The engagement wedge can have the unwedged position in response to the activation wedge in the inactive position, whereas the engagement wedge can have the wedged position in response to the activation wedge in the active position. The engagement wedge in the wedged position can be configured to engage against the receiver bore.

The latch can comprise a retention rod extending from the sleeve and can be moveable axially with the movement of the sleeve from the first axial position to the second axial position. The retention rod with the sleeve in the first axial position can hold the activation wedge in the inactive position, and the retention rod with the sleeve in the second axial position can release the activation wedge to move to the active position.

In a fourth configuration, the connector can further comprise a lock disposed on the connector. The lock can be operatively coupled to the anchor and can be movable at least from an unlocked condition to a locked condition. The lock in the locked condition can be configured to lock the activation wedge in the active position. The lock can also be movable from the locked condition to a released condition. The lock in the released condition can be configured to move the activation wedge from the active position to the inactive position, whereas the lock in the released condition can be configured to move the sleeve from the second axial position to the first axial position on the connector.

The lock can comprise a drive shaft, a pinion gear, and a lock rod. The drive shaft can extend from the connector and can be rotatable in a first direction. The pinion gear can be rotatable with the rotation of the drive shaft in the first direction. The lock rod can have a rack gear engaged with the pinion gear. The lock rod can be axially moveable between an unlocked position and a locked position in response to the rotation of the rack gear in the first direction. The lock rod in the unlocked position can permit movement of the activation wedge from the activation position, while the lock rod in the locked position can prevent movement of the activation wedge from the activation position.

In one example of the lock having the lock rod, the activation wedge can define a first lock surface, and the lock rod can define a second lock surface. The second lock surface on the lock rod in the unlocked position can be disengaged from the first lock surface of the activation wedge. Meanwhile, the second lock surface on the lock rod in the locked position can be engaged with the first lock surface of the activation wedge.

For this example, the anchor can comprise a plurality of the activation wedge and the engagement wedge disposed about a circumference of the connector. In this instance, the lock can comprise a circumferential gear rack, a plurality of second pinion gears, and a plurality of second lock rods. The circumferential gear rack can be disposed on the connector and can be engaged with the pinion gear. The circumferential gear rack can be rotatable about the circumference of the connector. The second pinion gears can be engaged with the circumferential gear rack and can be rotatable thereby. The second lock rods can each have a rack gear engaged with a respective one of the second pinion gears. Each second lock rod can be axially moveable between the unlocked position and the locked position in response to movement of the rack gear by the rotation of the respective second pinion gear. Each second lock rod in the unlocked position can have the first lock surface disengaged from the second lock surface of a respective one of the activation wedges. Each second lock rod in the locked position can have the first lock surface engaged with the second lock surface of the respective activation wedge and can prevent movement of the respective activation wedge from the activation position.

In another example of the lock having the lock rod, the activation wedge can define an inclined surface, and the lock rod can define a ratchet surface. A slip of the lock can be disposed between the inclined surface and the ratchet surface. The slip can be configured to grip between the inclined surface and the ratchet surface in response to the lock rod moved toward the locked position. Meanwhile, the slip can be configured to release between the inclined surface and the ratchet surface in response to the lock rod moved toward the unlocked position.

For this example, the anchor can comprise sets of the activation wedge and the engagement wedge disposed about a circumference of the connector. Each activation wedge can be movable independently to the activation position along the ratchet surface of the respective lock rod and can move the respective engagement wedge laterally into engagement with the receiver bore across a respective annular gap between the connector and the receiver bore. The slip of each activation wedge can be movable independently along the ratchet surface of the respective lock rod to engage the inclined surface. Additionally, each slip can be configured to provide an adjustable engagement point between the lock rod and the activation wedge such that the lock is configured to pull down evenly on each activation wedge.

In yet another example of the lock having the lock rod, the lock can be movable from the locked condition to a released condition. The lock in the released condition can be configured to move the activation wedge from the active position to the inactive position, while the lock in the released condition can be configured to move the sleeve from the second axial position to the first axial position on the connector. In this case, the drive shaft can be rotatable in a second direction opposite to the first direction, and the pinion gear can be rotatable with the rotation of the drive shaft in the second direction. The lock rod having the rack gear engaged with the pinion gear can be axially moveable between the locked position to a release position in response to movement of the rack gear by the rotation of the pinion gear in the second direction. The lock rod in the released position can engage a retention rod of the latch, can move the activation wedge from the active position to the inactive position, and can move the sleeve from the second axial position to the first axial position.

A vessel is disclosed herein for which a tubular component is used to communicate between the vessel and a subsea environment. The vessel comprises a balcony extending from a side of the vessel. The vessel also comprises a system as discussed above, whereby the system has the receiver supported on the balcony of the vessel and has the connector disposed on the tubular component.

A method is disclosed for a vessel. The method comprises: passing a tubular component through a receiver bore of a receiver supported on the vessel; inserting a connector disposed on the tubular component into the receiver bore; mechanically triggering a trigger disposed on the connector in response to engagement of the trigger with an engagement shoulder defined in the receiver bore; mechanically releasing a latch, in response to the mechanical triggering of the trigger, from a retracted condition to an extended condition on the connector, and latching the latch in the extended condition against a latch profile defined in the receiver bore; and mechanically anchoring an anchor disposed on the connector against the receiver bore in response to the mechanical release of the latch.

The method can further comprise locking the anchor against the receiver bore by mechanically moving a lock disposed on the connector from an unlocked condition to a locked condition. The method can also further comprise gripping a slip between the lock and the anchor in response to the lock is in the locked condition.

To insert the connector into the receiver bore, an external stop shoulder on the connector can be engaged against an inner stop shoulder defined in the receiver bore.

Mechanically releasing and latching the latch can comprise: moving a sleeve axially from a first axial position to a second axial position on the connector by biasing the sleeve with a first biasing element; moving at least one dog disposed in a first side opening of the connector laterally from a retracted position in conjunction with the sleeve in the first axial position to an extended position in conjunction with the sleeve in the second axial position; and engaging the at least one dog in the latch profile defined in the receiver bore.

To mechanically trigger the trigger, the latch is held in the first axial position by biasing a pin of the trigger disposed in a second side opening of the connector to an engaged condition. The pin in the engaged condition is engaged with the sleeve of the latch. The sleeve is released to move toward the second axial position by engaging the pin in the engaged condition against the engagement shoulder defined in the receiver bore and moving the pin from the engaged condition to a released condition.

To mechanically anchoring the anchor, an activation wedge of the anchor is held in an inactive position biased toward an active position on the connector. In response to the movement of the sleeve toward the second axial position, the activation wedge is released to move from the inactive position toward the active position. An engagement wedge of the anchor disposed in a second side opening of the connector is wedged by moving the engagement wedge laterally from an unwedged position in conjunction with the activation wedge in the inactive position to a wedged position in conjunction with the activation wedge in the active position.

To mechanically release the activation wedge to move in response to the movement of the sleeve toward the second axial position, the activation wedge is held in the inactive position with a retention rod extending from the sleeve. The retention rod moves axially with the movement of the sleeve from the first axial position to the second axial position. The activation wedge is released to move to the active position with the movement of the retention rod.

The method can further comprise locking the anchor against the receiver bore by mechanically moving a lock disposed on the connector from an unlocked condition to a locked condition.

In mechanically moving the lock, a drive shaft extending from the connector is rotated in a first direction, and a pinion gear is rotated with the rotation of the drive shaft. A lock rod having a rack gear engaged with the pinion gear is moved axially from an unlocked position to a locked position in response to the rotation of the pinion gear. Movement of the activation wedge is prevented from the activation position by engaging a first lock surface on the lock rod against a second lock surface of the activation wedge.

To engage the first lock surface on the lock rod against the second lock surface of the activation wedge, a first shoulder on the lock rod can engage against a second shoulder on the activation wedge. To engage the first lock surface on the lock rod against the second lock surface of the activation wedge, a ratchet surface on the lock rod can engage against a slip, and the slip can engage against an inclined surface on the activation wedge.

The anchor can comprise sets of the activation wedge and the engagement wedge disposed about a circumference of the connector. In anchoring the anchor, each activation wedge can move independently to the activation position along the ratchet surface of the respective lock rod. The respective engagement wedge can move laterally into engagement with the receiver bore across a respective annular gap between the connector and the receiver bore.

To engage the first lock surface on the lock rod against the second lock surface of the activation wedge, the slip of each activation moving can move independently along the ratchet surface of the respective lock rod to engage the inclined surface. An adjustable engagement point can be provided between lock rod and the activation wedge such that lock is configured to pull down evenly on each activation wedge.

The anchor can comprise a plurality of the activation wedge and the engagement wedge disposed about a circumference of the connector. To move the lock, a circumferential gear rack, which is disposed on the connector and is engaged with the pinion gear, can be rotated, and a plurality of second pinion gears engaged with the circumferential gear rack can thereby be rotated. A plurality of second lock rods having a second rack gear engaged with the second pinion gears can be moved axially from the unlocked position to the locked position in response to the rotation of the second pinion gear. Movement of the activation wedges can be prevented from the activation position by engaging the first lock surfaces on the second lock rod against the second lock surfaces of the activation wedges.

The method can further comprise releasing the lock from the locked condition to a released condition by moving the activation wedge from the active position to the inactive position and moving the sleeve from the second axial position to the first axial position on the connector.

The method can further comprise releasing the lock from the locked condition to a released condition by moving the activation wedge from the active position to the inactive position and moving the sleeve from the second axial position to the first axial position on the connector. In this case, releasing the lock can comprise: rotating the drive shaft in a second direction opposite to the first direction; rotating the pinion gear with the rotation of the drive shaft in the second direction; and moving the lock rod having the rack gear engaged with the pinion gear axially from the locked position to a release position in response to movement of the rack gear by the rotation of the pinion gear; engaging the lock rod in the released position against a retention rod of the latch mechanism; moving the activation wedge from the active position to the inactive position with the movement of the lock rod; and moving the sleeve from the second axial position to the first axial position with the movement of the lock rod engaged against the retention rod. Finally, the method can further comprise limiting bending of the tubular component using a bend limiter extending from an end of the connector.

The foregoing summary is not intended to summarize each potential embodiment or every aspect of the present disclosure.

DETAILED DESCRIPTION OF THE DISCLOSURE

Figure 1A:
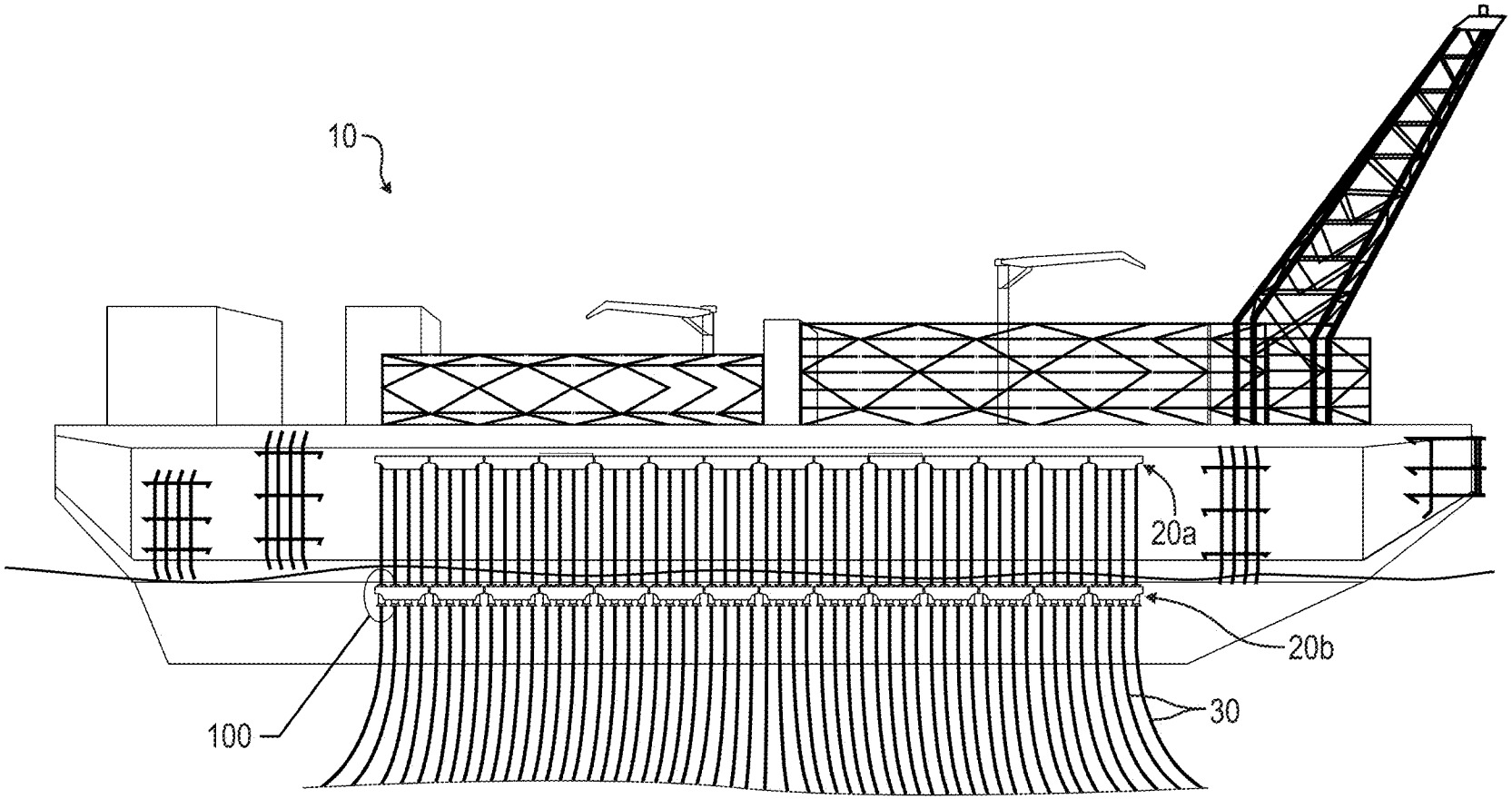
FIG. 1A illustrates a vessel having upper and lowers balconies with support systems for supporting risers.
Figure 1B:
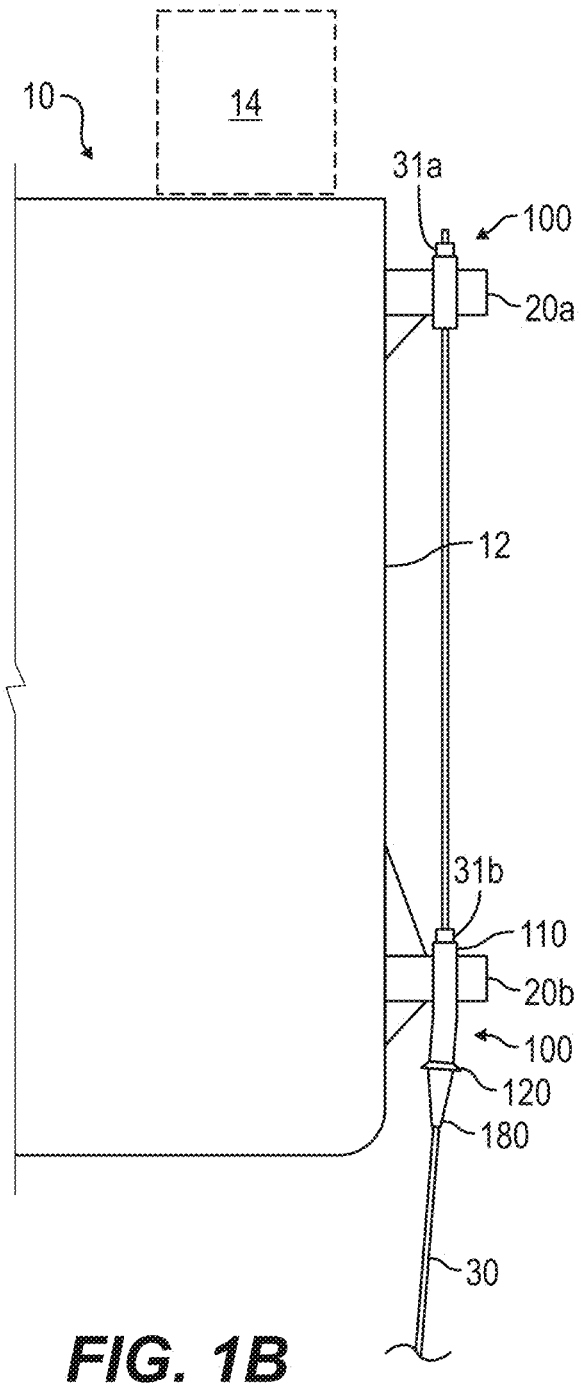
FIG. 1B illustrates an end view of a side of the vessel having upper and lowers balconies with support systems.

FIG. 1A illustrates a vessel 10 having upper and lowers platforms or balconies 20*a-b* for supporting tubular components 30, which extend subsea from the vessel 10. FIG. 1B illustrates a side 12 of the vessel 10 having the upper and lowers balconies 20*a-b* for supporting the tubular components 30.

As shown, the vessel 10 can be a floating production storage and offloading (FPSO) unit. The features of the present disclosure can be used with other types of structures and vessels. In general, the vessel 10 can include components for mobile offshore production and storage, and hydrocarbons produced from seabed wells can be transported to the vessel 10 using the tubular components 30, which can be flowlines or risers. Production facilities on the vessel 10 can then process the hydrocarbons by separating oil, gas, water, and impurities for storage in the hull of the vessel 10.

The tubular components 30 are used for communicating between the vessel 10 and components in a subsea environment. For example, the tubular components 30 can be flowlines, which can be flexible or rigid. In other examples, the tubular components 30 can be risers, which can be vertical transportation lines from the seabed to topside and which can be flexible or rigid. Other types of tubular components 30 can be used, such as umbilicals or power cables. In general, the tubular components 30 can conduct well fluids, injection fluids, etc. The tubular components 30 can also conduct electricity, electronic signals, hydraulics, and the like.

As shown, the upper and lower balconies 20*a-b* extend from the side 12 of the vessel 10 to support the tubular components 30. The lower balconies 20*b* may be situated below the minimum draft of the vessel 10, and the upper balconies 20*a* may be supported close to the deck level of the vessel. Support systems 100 are supported on the balconies 20*a-b* of the vessel 10 to hold the tubular components 30.

The lower balconies 20*b* and the support system s100 can support the tubular components 30 close to the vessel's keel level. In one arrangement, the receivers 110 on the lower balcony 20*b* can be vertically straight relative to the side 12 of the vessel 10. In an alternative arrangement, the receivers 110 can be angled or oriented away from vertical to disperse or spread the tubular components 30 as they extend below the vessel 10.

According to one arrangement of the present disclosure, the disclosed support system 100 can be used to support the tubular components 30 on one of the balconies 20*a-b*, while another support system is used on the other balcony 20*a-b*. According to another arrangement such as shown in FIG. 1B, the same support system 100 disclosed herein can be used to support the tubular components 30 on both of the balconies 20*a-b* depending on the implementation.

As best shown on the example lower balcony 20*b* in FIG. 1B, the support system 100 includes a receiver 110 and a connector 120. The receiver 110 is supported on one or both of the vessel's balconies 20*a-b* of the vessel 10 depending on how the associated tubular component 30 is to be supported on the vessel 10. For example, the receiver 110 can be integrated into or affixed on either one or both of the balcony 20*a-b* of the vessel 10. The receiver 110 receives the connector 120, which is disposed on the tubular component 30.

Equipment 14 on the vessel 10 can be used with the tubular components 30. For example, the equipment 14 can include a top interface spool (not shown), which can be located at the deck of the vessel 10 above the upper receiver 110 and can connect to a termination 31*a* of the tubular component 30. The equipment 14 can include a pull-in platform (not shown), which can be located above the upper balcony 20*a* and can be used to pull in the tubular component 30 through one or both of the receivers 110 on the balconies 20*a-b* depending on how the tubular component 30 is to be supported. Using a pull-in operation, for example, the tubular component 30 can be pulled from the water to connect to the vessel 10 using the pull-in platform of the equipment 14. A pull-in wire can connect by a pull-in head to a termination 31*a* of the tubular component 30, and the tubular component 30 can be passed through the receiver 110 on the lower balcony 20*b* until reaching the support system 100 on the upper balcony 20*a*.

The support system 100 on the lower balcony 20*b* provides an interface for the tubular component 30. As noted above, the support system 100 can be used for tubular components 30 that are either rigid or flexible. Accordingly, for a flexible tubular component 30, such as an umbilical, flexible pipe, rigid pipe, or power cable, the support system 100 on the lower balcony 20*b* can provide a hang-off interface for a bend limiter 180 to provide stiffening.

For a rigid tubular component 30, the support system 100 on the lower balcony 20*b* can provide an interface for hang-off of a pipe support for a riser. For example, the connector 120 of the support system 100 can fill a gap between a bore of the receiver 110 and an outer diameter (OD) of a rigid pipe support (e.g., tubular 36 in FIG. 8C) after larger sections of a riser 30 have passed through the receiver 110. An internal wear sleeve (not shown) can line the inner diameter (ID) of the connector 120 to protect any coating on the riser 30 as larger diameters of the riser 30 pass through the connector 120. If desired, a flexible joint can be provided on the riser 30 at the point below the lower balcony 20*b* to provide flexibility.

In one configuration of the support system 100, the weight of the tubular component 30 can be carried by the top termination 31*a* at the level of the upper balcony 20*a*. In another configuration of the support system 100, the connector 120 at the lower balcony 20*b* can include additional latching features (e.g., balls or dogs) that increase the hang-off capacity to carry a complete weight (or at least a portion of the complete weight) of the tubular component 30 at the lower balcony 20*b*.

When the support system 100 is being used, the connector 120 on the tubular component 30 is engaged in the receiver 110 to complete traction support of the tubular component 30. At the lower balcony 20*b*, the connector 120 mechanically latches and anchors inside the receiver 110. Once latched and anchored, diverless operations can be performed to mechanically lock or rigidize the connector 120 in the receiver 110. For example, a remote operated vehicle (ROV) can be deployed below the water line to mechanically operate locking features on the connector 120 to lock or rigidize it in the receiver 110.

With the arrangements described above, the traction can secure the tubular component 30 to the side of the vessel 10. Therefore, dynamic movements of the vessel 10 are not expected to cause relative movement between the tubular component 30 and the support structures (balconies 20*a-b*, support systems 100, etc.) used to secure the tubular component 30 to the vessel 10. Meanwhile, the receiver 110 and the connector 120 provide lateral stabilization of the tubular component 30, and the locking features on the connector 120 are mechanically actuated to provide the hang-off interface (e.g., a bend limiter 180 for a flexible tubular component 30 or a wear sleeve for a rigid tubular component 30). Moreover, the mechanical actuation of the support system 100 rigidizes the connector 120 to the receiver 110 to improve fatigue performance of the system's components over the life of the installation.

In general, the support system 100 is versatile and can be used with rigid or flexible tubular components 30 with various inner diameters. The support system 100 also has versatility in that it allows interconnections of the tubular components 30 to be made on the port or the starboard side 12 of the vessel 10. The support system 100 can also reduce the length of any rigid ducts required for a subsea assembly because the support system 100 allows connections by keel hauling and optimizes interconnection operations.

Figure 2:
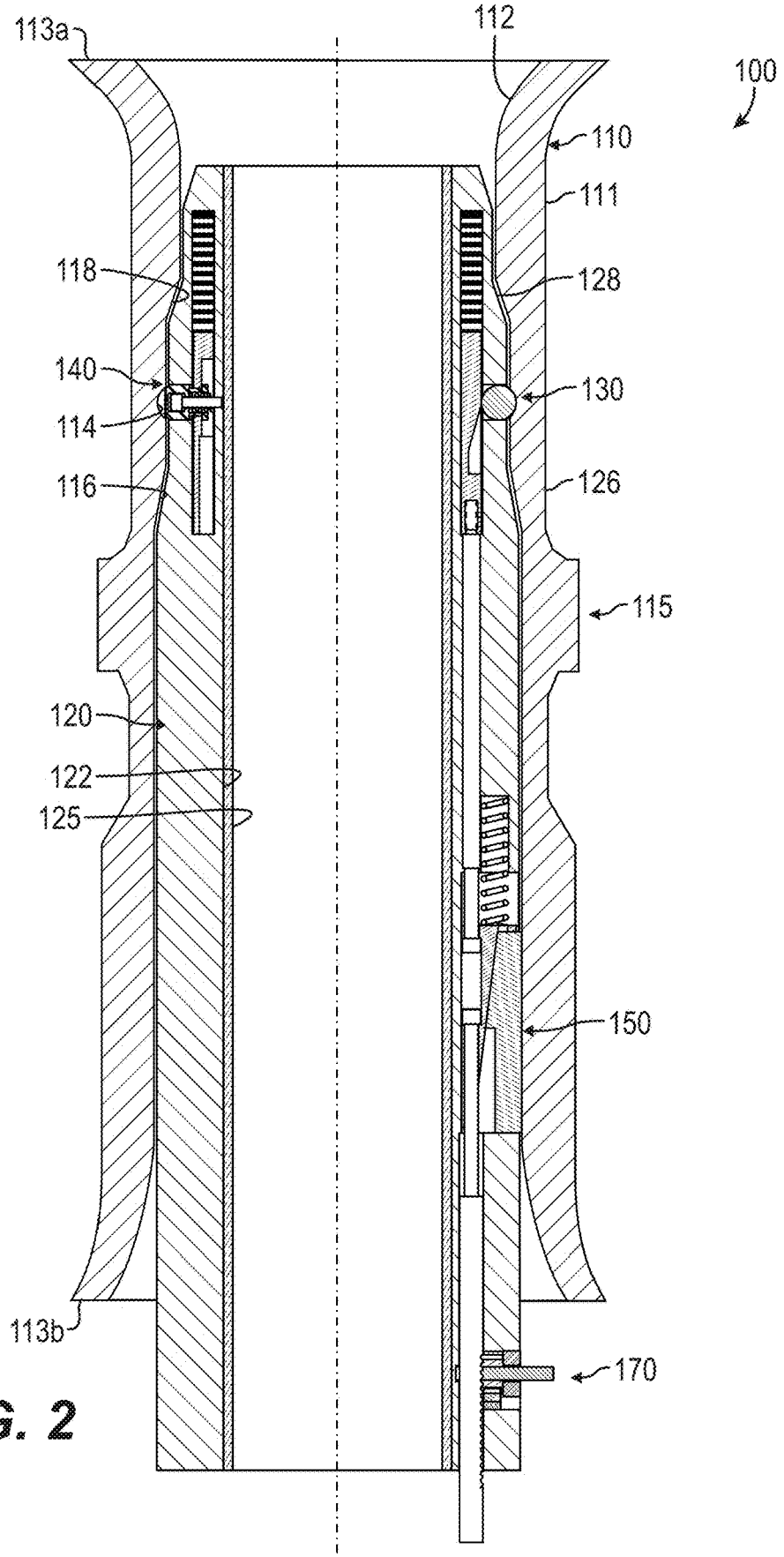
FIG. 2 illustrates a cross-section of a support system, including a receiver with a connector positioned therein.
Figure 3:
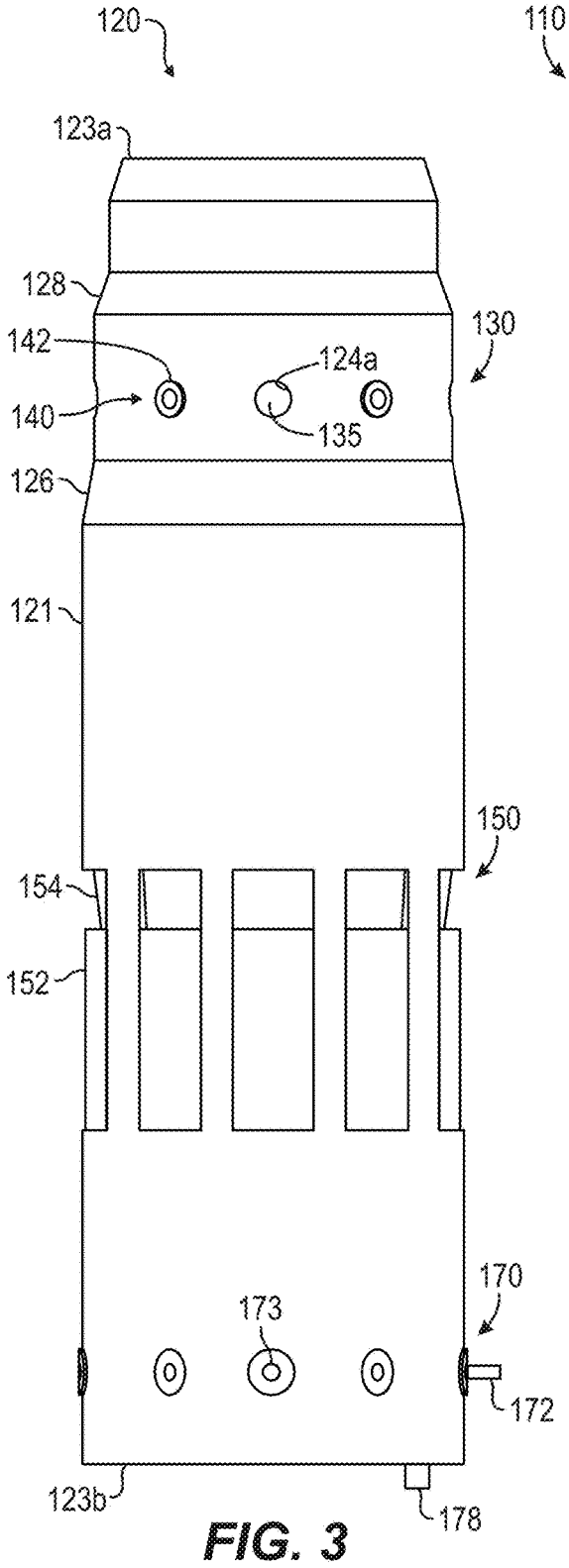
FIG. 3 illustrates an elevational view of the connector.
Figure 4:
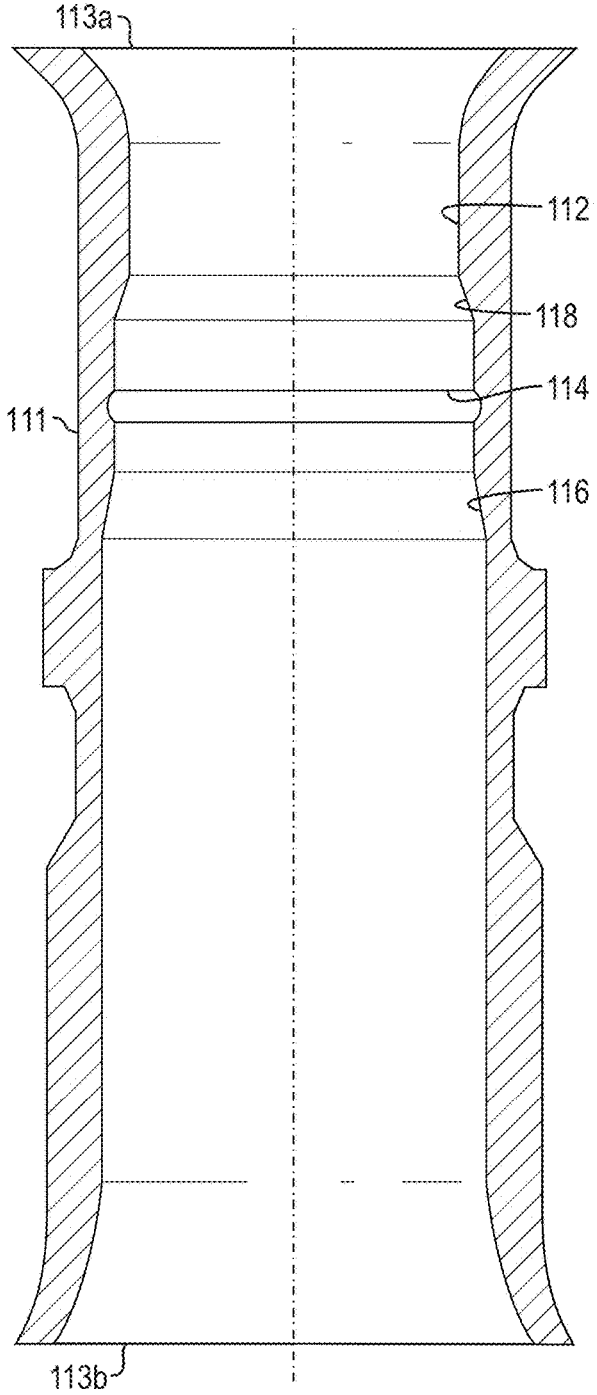
FIG. 4 illustrates a cross-section of a receiver for the support system for use with the connector.

Given the overview above, FIG. 2 illustrates a cross-section of a support system 100 according to the present disclosure. The support system 100 includes a receiver 110 and a connector 120, which can be removably positioned in the receiver 110. In FIG. 2, the connector 120 is shown positioned in the receiver 110. The receiver 110 is configured to be supported on a vessel (not shown). As noted above, for example, the receiver 110 can be supported on a balcony (20*a-b*) on the side (12) of the vessel (10). For further reference, FIG. 3 shows an elevational view of the connector 120, and FIG. 4 shows a cross-sectional view of the receiver 110.

The receiver 110 has a body 111, which can be cylindrical as shown. The receiver body 111 has an upper end 113*a* and a lower end 113*b* and defines a receiver bore 112 therethrough. The receiver body 111 can be an integrated component or may be comprised of several interconnected components for the purposes of assembly. The ends 113*a-b* can define bell mouths. Other features 115, such as connection flanges, ROV grab handles, and the like, may be provided on the receiver 110 for suitable purposes. Internally, the receiver bore 112 defines an engagement shoulder 116 and a latch profile 114 therein. The receiver bore 112 can also define a stop shoulder 118 toward the upper end 113*a*.

The connector 120 has a body 121, which can be cylindrical as shown. The connector body 121 has an upper end 123*a* and a lower end 123*b* and defines a connector bore 122 therethrough. The body 121 can be an integrated component or may be comprised of several interconnected components for the purposes of assembly. The connector 120 is disposed on the tubular component (not shown), which passes through the connector bore 122. As noted above and as shown here, an internal wear sleeve 125 can line the connector bore 122 and can protect any coatings or surfaces on the tubular component (not shown) passed through the connector bore 122.

The connector 120 has a latch 130, a trigger 140, and an anchor 150—each of which can be an assembly, a mechanism, or the like and can have one or more components. The latch 130 (e.g., latch assembly) is disposed on the connector 120 and is mechanically movable at least from a retracted condition to an extended condition on the connector 120. The latch assembly 130 in the extended condition is configured to latch in the latch profile 114 in the receiver bore 112.

The trigger 140 (e.g., trigger assembly) is disposed on the connector 120 and is operatively coupled to the latch assembly 130. The trigger assembly 140 is triggered in response to engagement of the trigger assembly 140 with the engagement shoulder 116 when the connector 120 is inserted into the lower end 113*b* of the receiver 110 and is passed into the receiver bore 112 as the tubular component (not shown) is pulled in the water to the vessel. When triggered, the trigger assembly 140 is configured to mechanically move (trigger, initiate, or instigate movement of) the latch assembly 130 from the retracted condition to the extended condition.

The anchor 150 (e.g., anchor assembly) is disposed on the connector 120 and is operatively coupled to the latch assembly 130. The anchor assembly 150 is configured to mechanically anchor, wedge, or otherwise engage against the receiver bore 112 in response to the latch assembly 130 being moved to the extended condition.

Finally, the connector 120 can further include a lock 170 disposed on the connector 120. Again, the lock 170 can be an assembly, a mechanism, or the like and can have one or more components. The lock 170 (e.g., lock assembly 170) is configured to rigidly lock the anchor assembly 150 engaged inside the receiver bore 112. The lock assembly 170 is operatively coupled to the anchor assembly 150 and is mechanically movable from an unlocked condition to a locked condition. The lock assembly 170 in the locked condition is configured to lock the anchor assembly 150 against the receiver bore 112.

As noted, the receiver bore 112 can define the inner stop shoulder 118 therein. The latch profile 114 is disposed between the engagement shoulder 116 and this inner stop shoulder 118. The connector 120 can include external stop shoulders 126, 128 configured to respectively engage against the inner stop shoulder 118 and the engagement shoulder 116, which limits the insertion of the connector 120 into the receiver bore 112 of the receiver 110.

Figure 5A:
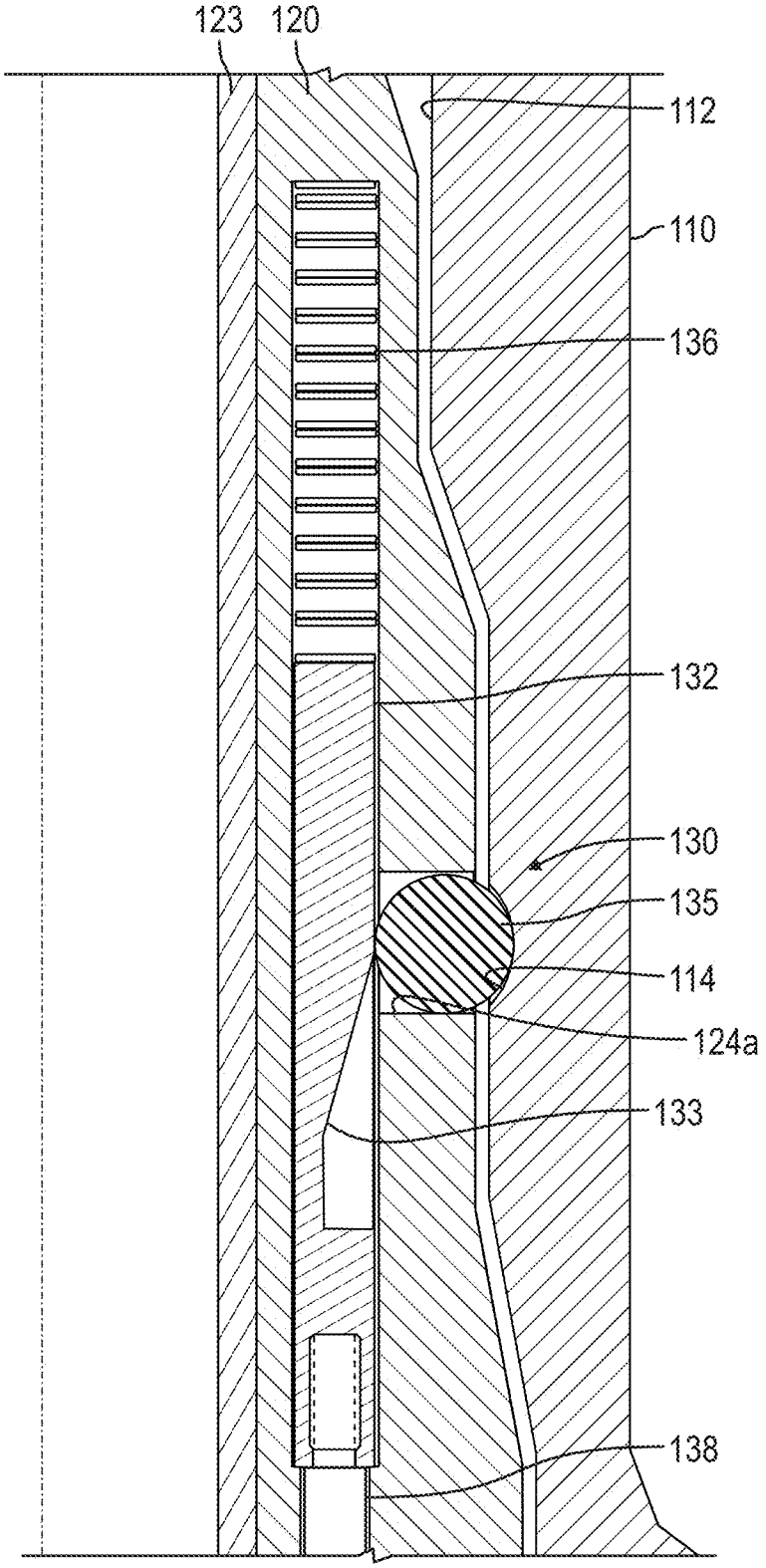
FIG. 5A illustrates a detailed cross-section of a latch of the connector.
Figure 5B:
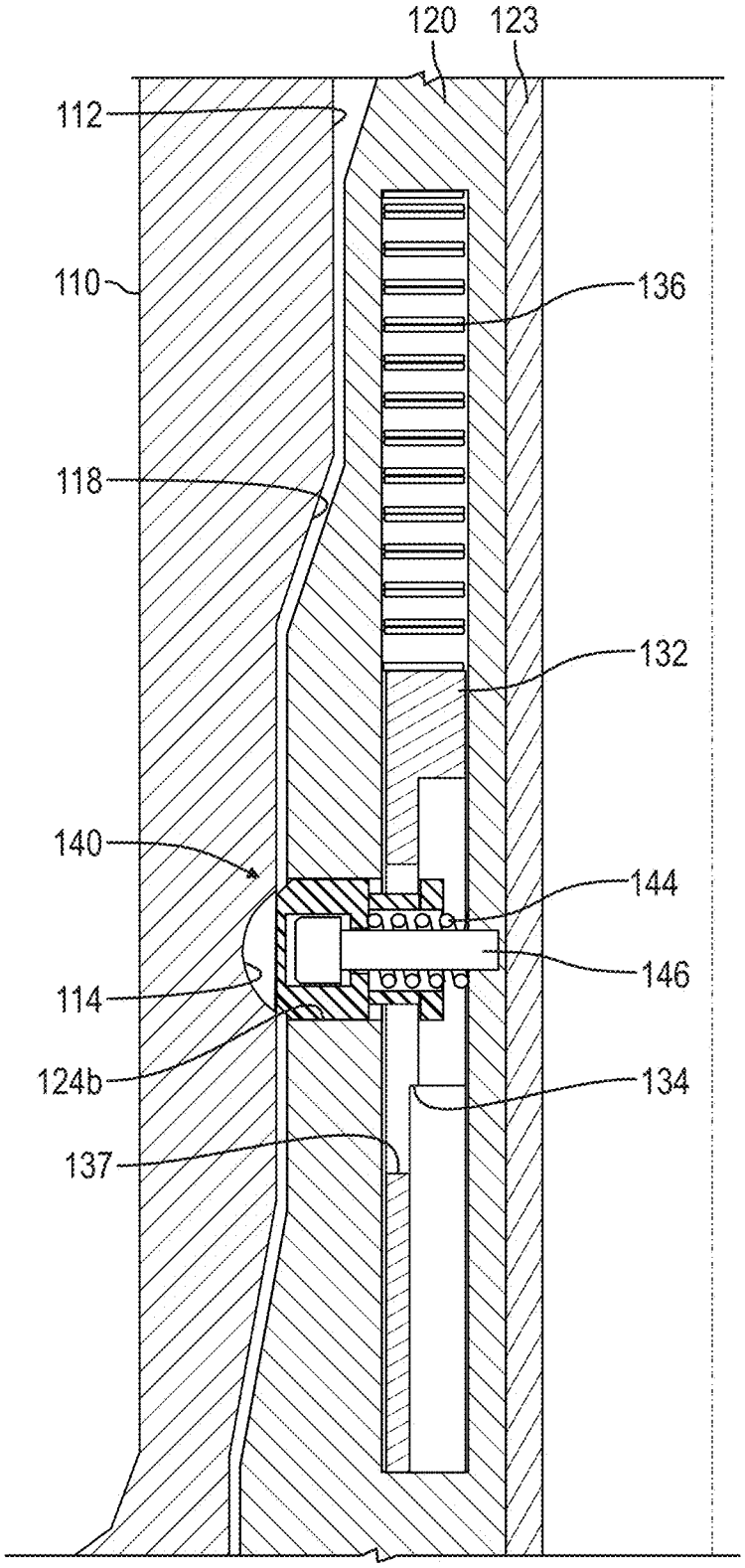
FIG. 5B illustrates a detailed cross-section of a trigger of the connector.
Figure 5C:
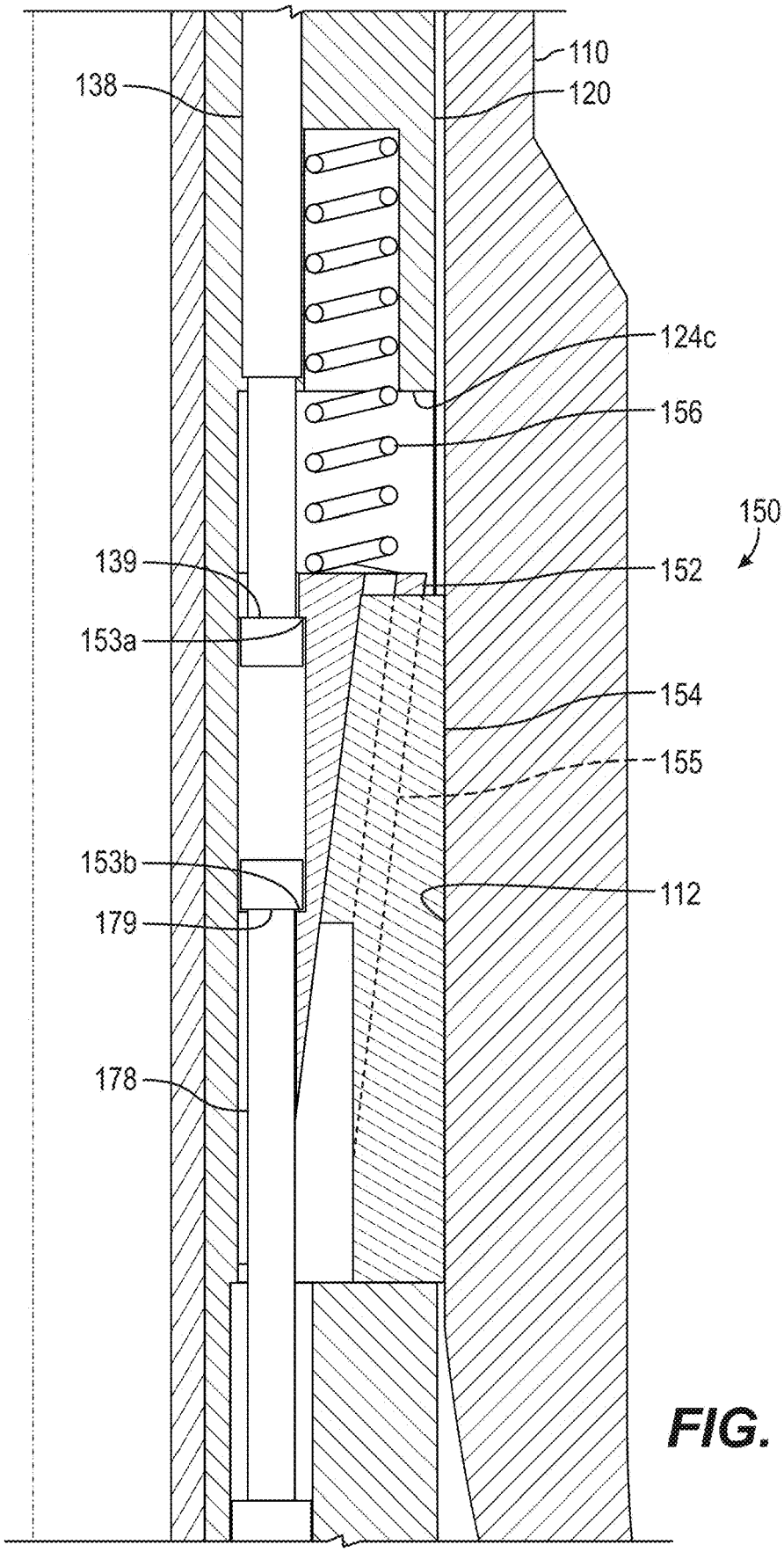
FIG. 5C illustrates a detailed cross-section of an anchor of the connector.

Further details of the assemblies 130, 140, and 150 on the connector 120 are shown in FIGS. 5A-5C. To wit, FIG. 5A illustrates a detailed cross-section of the latch assembly 130 of the connector 120, and FIG. 5B illustrates a detailed cross-section of the trigger assembly 140 of the connector 120. Meanwhile, FIG. 5C illustrates a detailed cross-section of the anchor assembly 150 of the connector 120.

As best shown in FIG. 5A, the latch assembly 130 includes a sleeve 132, a first biasing element 136, and at least one latch element or dog 135. The sleeve 132 is axially moveable from a first (upper) axial position to a second (lower) axial position (shown) inside a pocket or space of the connector 120. The first biasing element 136 biases the sleeve 132 from the first axial position toward the second axial position. The at least one latch dog 135 is disposed in a first side opening 124*a* of the connector 120 and is laterally moveable from a retracted position when the sleeve 132 in the first axial position to an extended position (shown) when the sleeve 132 in the second axial position.

The at least one latch dog 135 can include a plurality of bearings, balls, or dogs that are disposed in respective ones of the first side openings 124*a* of the connector 120 and are arranged about a circumference of the connector 120. A slanted pocket 133 in the side of the sleeve 132 can allow the latch dog 135 to move laterally depending on the axial position of the sleeve 132. The first biasing element 136 can include one or more coil springs, disc springs, or the like. As only partially shown in FIG. 5A, the sleeve 132 connects to retention rods 138, which extend from the sleeve 132 and operatively connect to the anchor assembly 150 as discussed below.

As best shown in FIG. 5B, the trigger assembly 140 includes a trigger pin 142, a second biasing element or coil spring 144, and a support pin 146. The trigger pin 142 is supported on the support pin 146 disposed on the connector 120, and the trigger pin 142 is disposed in a second side opening 124*b* of the connector 120. The second biasing element 144 biases the trigger pin 142 from a released condition to an engaged condition relative to the second side opening 124*b*.

The trigger pin 142 in the engaged condition is engaged with the sleeve 132 of the latch assembly 130 and holds the latch assembly 130 in the first axial position. For example, the trigger pin 142 is engaged with a shoulder 134 on the sleeve 132, which holds the sleeve 132 in the upper axial position against the bias of the latch spring 136. As shown, the sleeve 132 can define a longitudinal slot 137 that allows the sleeve 132 to move longitudinally relative to the trigger pin 142, the coil spring 144, and the support pin 146 that pass perpendicularly to the sleeve 132.

As the connector 120 is inserted into the receiver bore 112 as is depicted herein in FIG. 5B, the connector 120 is centralized in the receiver 110. The trigger pin 142 in the engaged condition engages with the engagement shoulder 116 of the receiver bore 112 and moves to the released condition. In the released condition as shown, the trigger pin 142 releases the sleeve 132 to move toward the second axial position. For example, the trigger pin 142 is moved away from the shoulder 134 on the sleeve 132. This allows the latch spring 136 to move the sleeve 132 toward the lower axial position. As the sleeve 132 moves and as best shown in FIG. 5A noted above, the sleeve's slanted pocket 133 pushes the latch dog 135 outward from the side of the connector 120 so the latch dog 135 can engage in the latch profile 114 of the receiver bore 112.

As with the other features on the connector 120, a plurality of the trigger assembly 140 shown in FIG. 5B can be disposed about the circumference of the connector 120. As the connector 120 is inserted into the receiver bore 112 through the lower end (113*b*), it is possible that one or more of the trigger assemblies 140 may engage against the inner surface of the receiver bore 112, causing the trigger pins 142 to move and to free the shoulder 134 of the sleeve 132 from support. To prevent premature activation, all of the trigger assemblies 140 disposed about the circumference of the connector 120 must be triggered together so the latch assembly 130 can be released. This ensures that triggering is not achieved until the connector 120 is fully inserted in the receiver bore 112 and each of the trigger pins 142 can engage the engagement shoulder 116 together while the connector 120 is inserted in the receiver bore 112.

As best shown in FIG. 5C, the anchor assembly 150 uses a slip or wedge arrangement to anchor inside the receiver bore 112. In particular, the anchor assembly 150 includes an activation wedge 152, a third biasing element 156, and an engagement wedge 154. The activation and engagement wedges 152, 154 have complementary wedging surfaces and may be interleaved with one another by using interleaved tracks 155 and edges. The activation wedge 152 is axially moveable at least from an inactive position to an active position on the connector 120, and the third biasing element 156, which can be a coil spring, biases the activation wedge 152 from the inactive position toward the active position. As shown here, the active position corresponds to the activation wedge 152 being in a lower position with the activation wedge 152 more interleaved with the engagement wedge 154. This is in contrast to the inactive position in which the activation wedge 152 is in an upper position with the activation wedge 152 less interleaved with the engagement wedge 154.

Meanwhile, the engagement wedge 154 is disposed in a third side opening 124*c* of the connector 120 and is laterally moveable from an unanchored, unwedged, or disengaged position (when the activation wedge 152 is in the inactive position) to an anchored, wedged, or engaged position (when the activation wedge 152 is in the active position). The engagement wedge 154 in the wedged position can anchor, wedge, or otherwise engage against the receiver bore 112.

As noted above, the latch assembly (130; FIG. 5A) is operatively coupled to the anchor assembly 150. In particular, the latch assembly (130) includes a retention rod 138 that extends from the sleeve (132). The retention rod 138 is moveable axially with the movement of the sleeve (132) from the first axial position to the second axial position. The retention rod 138 with the sleeve (132) in the first axial position holds the activation wedge 152 in the inactive position. For example, a shoulder 139 on the retention rod 138 engages a shoulder 153*a* on the activation wedge 152. This holds the activation wedge 152 in the inactive position and prevents the spring 156 from moving the activation wedge 152. When the sleeve (132) is moved to its second axial position, the retention rod 138 also moves, which releases the activation wedge 152 so the spring 156 can move the activation wedge 152 to the active position.

Figure 6A:
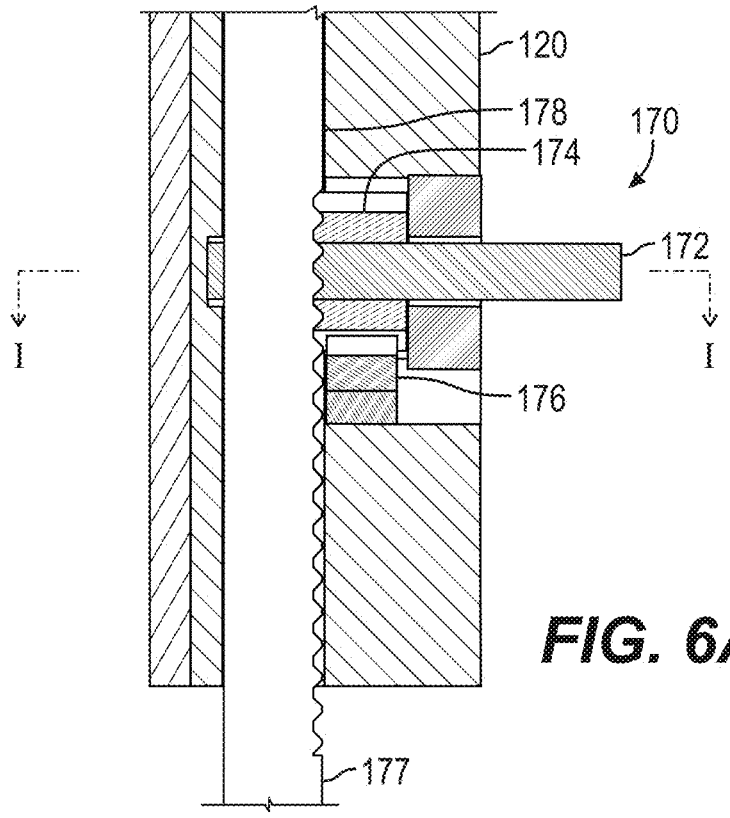
FIG. 6A illustrates a detailed cross-section of a lock of the connector.
Figure 6B:
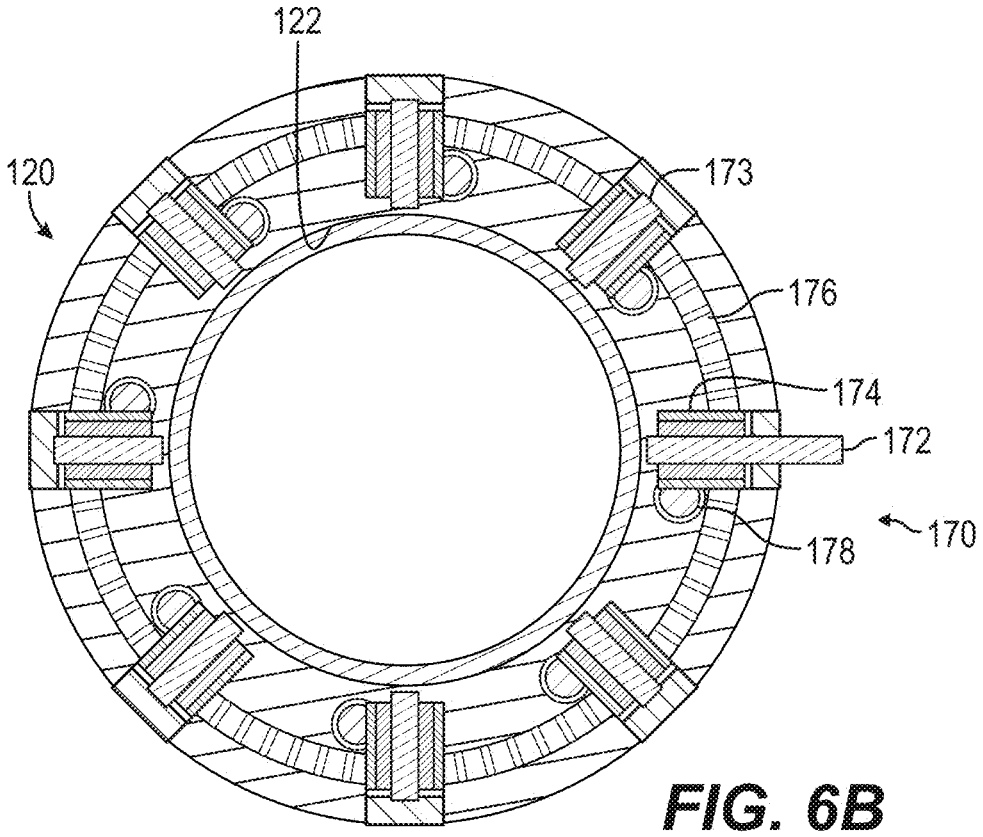
FIG. 6B illustrates a detailed end-section of the lock of the connector.

Turning now to the lock assembly 170, FIG. 6A illustrates a detailed cross-section of the lock assembly 170 of the connector 120, and FIG. 6B illustrates an end-section of the connector 120, taken generally along line 1-1 in FIG. 6A. As best shown in FIG. 6A, the lock assembly 170 includes a drive shaft 172, a pinion gear 174, and a lock rod 178. The drive shaft 172 extends from the connector 120 and is rotatable at least in a first direction. For example, an ROV can engage the drive shaft 172 to turn the drive shaft 172 after (i) the connector 120 has been inserted into the receiver 110, (ii) the latch assembly (130; FIG. 5A) has been latched, and (iii) the anchor assembly (150; FIG. 5C) has been initially anchored in the receiver 110.

The pinion gear 174 is rotatable with the rotation of the drive shaft 172. The lock rod 178 has a rack gear 177 engaged with the pinion gear 174. The lock rod 178 is axially moveable between an unlocked position and a locked position in response to the rotation of the pinion gear 174. As will be appreciated, various bearings, support elements, and other features (not explicitly shown) may be provided for the components of the lock assembly 170.

As also noted above, the lock assembly 170 is operatively coupled to the anchor assembly 150. As shown in FIG. 5C, the lock rod 178 in the unlocked position has a first lock surface or shoulder 179 disengaged from a second lock surface or shoulder 153*b* of the activation wedge 152. When the lock rod 178 is moved to a locked position, the first lock surface 179 is engaged with the second lock surface 153*b* of the activation wedge 152. This engagement prevents movement of the activation wedge 152 from its activation position, thereby locking the engagement wedge 154 engaged against the receiver bore 112.

As hinted above, the anchor assembly 150 of FIG. 5C includes a plurality of the activation wedge 152 and the engagement wedge 154 disposed about a circumference of the connector 120. To lock the plurality of the engagement wedges 154, the lock assembly 170 as shown in FIG. 6B includes a circumferential gear rack 176, a plurality of second pinion gears 174, and a plurality of second lock rods 178. The second pinion gears 174 are disposed on bearing shafts 173 and are engaged between the circumferential gear rack 176 and the rack gears on the second lock rods 178, which are operatively connected to respective anchor assemblies 150.

The circumferential gear rack 176 is disposed on the connector 120 and is engaged with the pinion gears 174. The circumferential gear rack 176 can be rotatable about the circumference of the connector 120 when the drive shaft 172 rotates its pinion gear 174. As a result, the following pinion gears 174 engaged with the circumferential gear rack 176 are also rotated about their bearing shafts 173 so the additional lock rods 178 can be moved axially in the manner noted above to lock their respective engagement wedges 154.

Given the details described above, discussion now turns to the process for connecting the support system 100. To that end, FIGS. 7A-7C show the process for connecting the connector 120 inside the receiver 110 to support a tubular component (not shown).

Figure 7A:
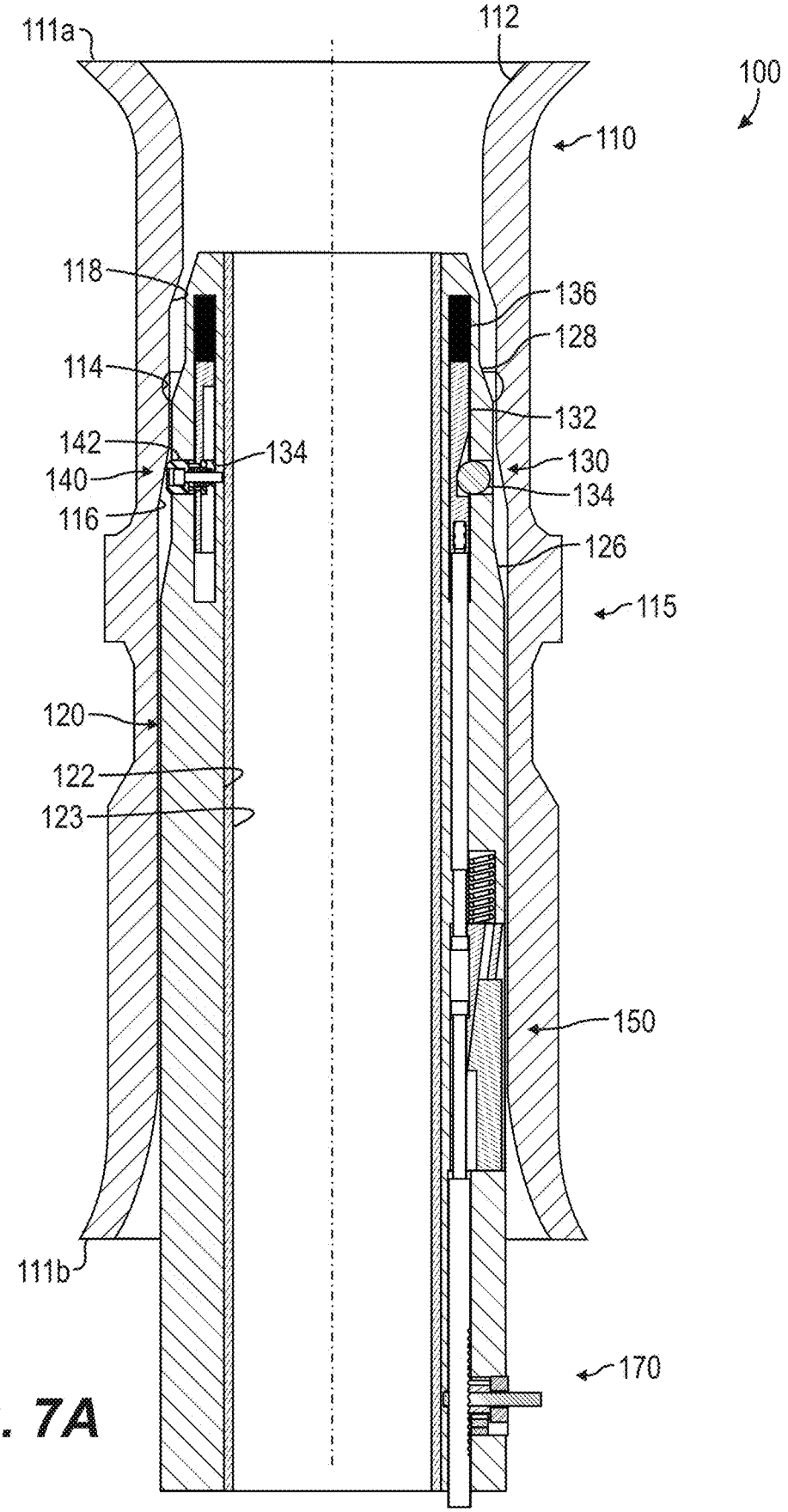
FIG. 7A illustrates a cross-section of the receiver receiving the connector.

Initially, FIG. 7A illustrates a cross-section of the receiver 110 receiving the connector 120. The receiver 110 is supported on the vessel (10), and the connector 120 is already disposed on the tubular component (not shown). The tubular component (30) is passed through the receiver bore 112 until the connector 120 on the tubular component (30) is inserted into the lower end 113*b* of the receiver bore 112. When the connector 120 is inserted to an appropriate extent inside the receiver bore 112, the trigger assembly 140 can be triggered in response to engagement of the trigger assembly 140 with the engagement shoulder 116 inside the receiver bore 112. As noted, all the trigger assemblies 140 disposed about the circumference of the connector 120 may need to be triggered together so the latch assembly 130 can be released.

When triggering the trigger assembly 140, the latch assembly 130 is initially held in the first axial (upward) position by biasing the trigger pin 142 disposed in the second side opening (124*b*) of the connector 120 to the engaged condition. The trigger pin 142 in the engaged condition is engaged with the shoulder 134 of the sleeve 132 of the latch assembly 130, which prevents movement of the sleeve 132. In the triggering process, the sleeve 132 is then released to move toward the second axial (lower) position when the trigger pin 142 engages against the engagement shoulder 116 and the trigger pin 142 moves from the engaged condition to a released condition away from the sleeve's shoulder 134. Once the trigger assembly 140 is released, the sleeve 132 biased by the first biasing element 136 is urged downward and attempts to push the latch dogs 135 radially outward.

Figure 7B:
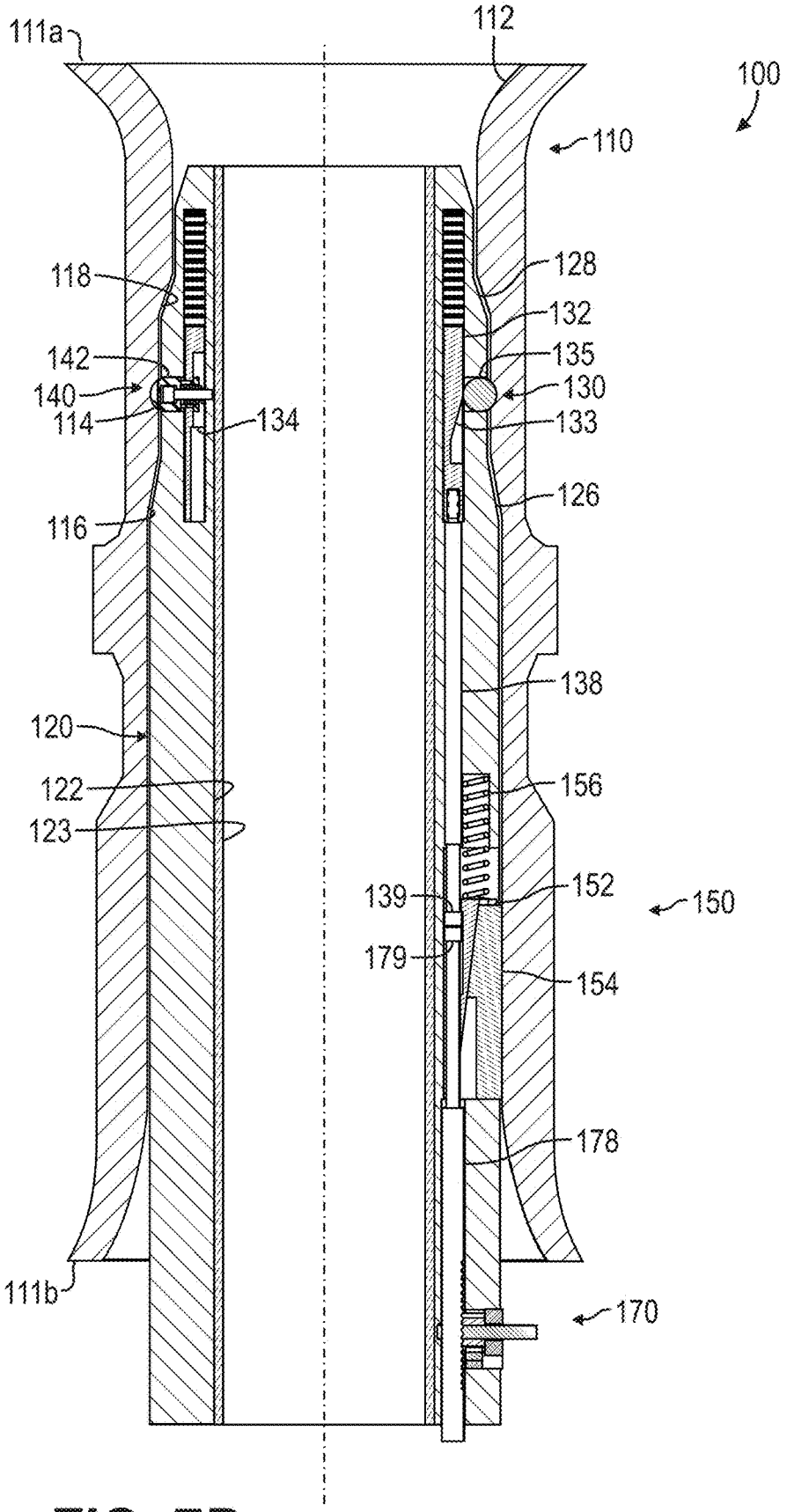
FIG. 7B illustrates a cross-section of the receiver during initial latching of the connector.
Figure 7C:
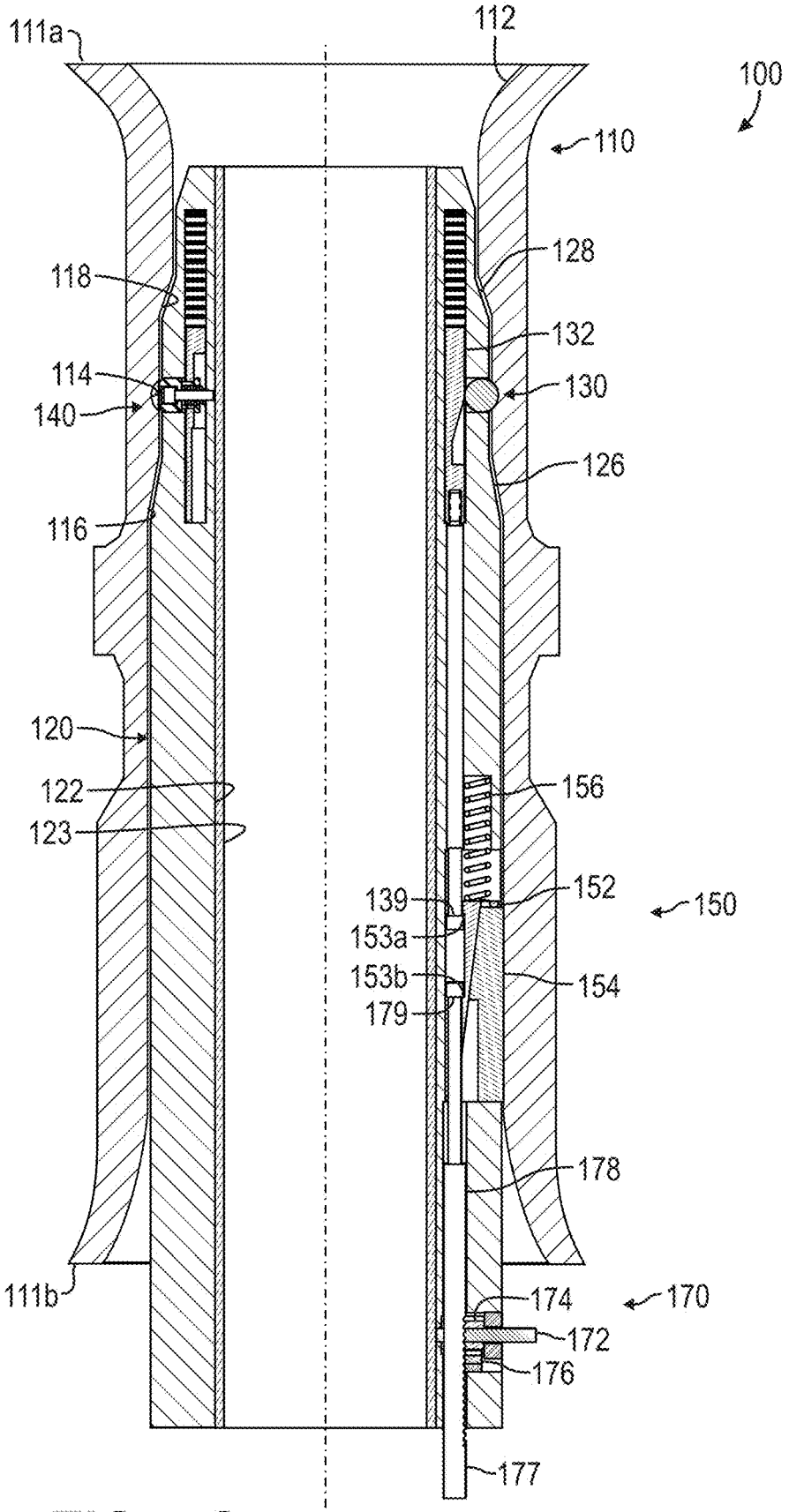
FIG. 7C illustrates a cross-section of the receiver during final latching of the connector.

FIG. 7B now illustrates a cross-section of the receiver 110 during the initial latching of the connector 120. Eventually, as the connector 120 is inserted into the receiver bore 112 as shown here, the external stop shoulder 128 on the connector 120 engages against the inner stop shoulder 118 defined in the receiver bore 112. In response to the triggering discussed above, the connection process involves releasing the latch assembly 130, moving the latch assembly 130 from a retracted condition to an extended condition on the connector 120, and latching the latch assembly 130 in the extended condition. In particular, the sleeve 132 is released by the triggering of the trigger assembly 140. To then latch, the released sleeve 132 moves axially from the upper axial position to the lower axial position on the connector 120 by the bias on the sleeve 132 provided by the first biasing element 136. The at least one latch dog 135 (e.g., bearing, ball, or other latch element) disposed in the first side opening (124*a*) of the connector 120 moves laterally from a retracted position (when the sleeve 132 in the upper axial position) to an extended position (when the sleeve 132 in the lower axial position as shown) so the at least one latch dog 135 can engage in the latch profile 114 in the receiver bore 112.

In response to the latch assembly 130 moving to the extended condition, the anchor assembly 150 disposed on the connector 120 is anchored against the receiver bore 112. As discussed above, anchoring of the anchor assembly 150 involves: initially holding the activation wedge 152 in an inactive position biased toward an active position on the connector 120; releasing the activation wedge 152 to move from the inactive position toward the active position as shown here in response to the movement of the sleeve 132 toward the lower axial position; and wedging an engagement wedge 154 disposed in a third side opening (124*c*) of the connector 120 by moving the engagement wedge 154 laterally from an unwedged position (when the activation wedge 152 in the inactive position) to a wedged position (when the activation wedge 152 in the active position as shown).

In releasing the activation wedge 152 to move in response to the movement of the sleeve 132 toward the lower axial position, the activation wedge 152 is initially held in the inactive position with the shoulder 139 of the retention rod 138 extending from the sleeve 132 and engaged with the shoulder 153*a* of the activation wedge 152. The retention rod 138 moves axially with the movement of the sleeve 132 from the upper axial position to the lower axial position so the activation wedge 152 is released to move by the bias of the spring 156 to the active position with the movement of the retention rod 138.

FIG. 7C now illustrates a cross-section of the receiver 110 during final latching of the connector 120. In the latching process, the anchor assembly 150 can be locked against the receiver bore 112 by moving the lock assembly 170 disposed on the connector 120 from an unlocked condition to a locked condition. To move the lock assembly 170, the drive shaft 172 extending from the connector 120 is rotated in a first direction. The pinion gear 174 rotates with the rotation of the drive shaft 172, and the lock rod 178 having the rack gear 177 engaged with the pinion gear 174 moves axially from an unlocked position to a locked position in response to the rotation of the pinon gear 174. Movement of the activation wedge 152 from the activation position is now prevented by the engagement of a first lock surface 179 on the lock rod 178 against a second lock surface 153*b* of the activation wedge 152.

As noted, the anchor assembly 150 includes a plurality of the activation wedge 152 and the engagement wedge 154 disposed about a circumference of the connector 120. Therefore, moving the lock assembly 170 includes: rotating a circumferential gear rack 176 disposed on the connector 120 engaged with the pinion gear 174; rotating a plurality of second pinion gears 174 engaged with the circumferential gear rack 176; moving a plurality of second lock rods 178 having a second rack gear 177 engaged with the second pinion gears 174 axially from the unlocked position to the locked position in response to the rotation of the second pinion gear 174; and preventing movement of the activation wedges 152 from the activation position by engaging the first lock surfaces 179 on the second lock rod 178 against the second lock surfaces 153*b* of the second activation wedges 152.

Figure 7D:
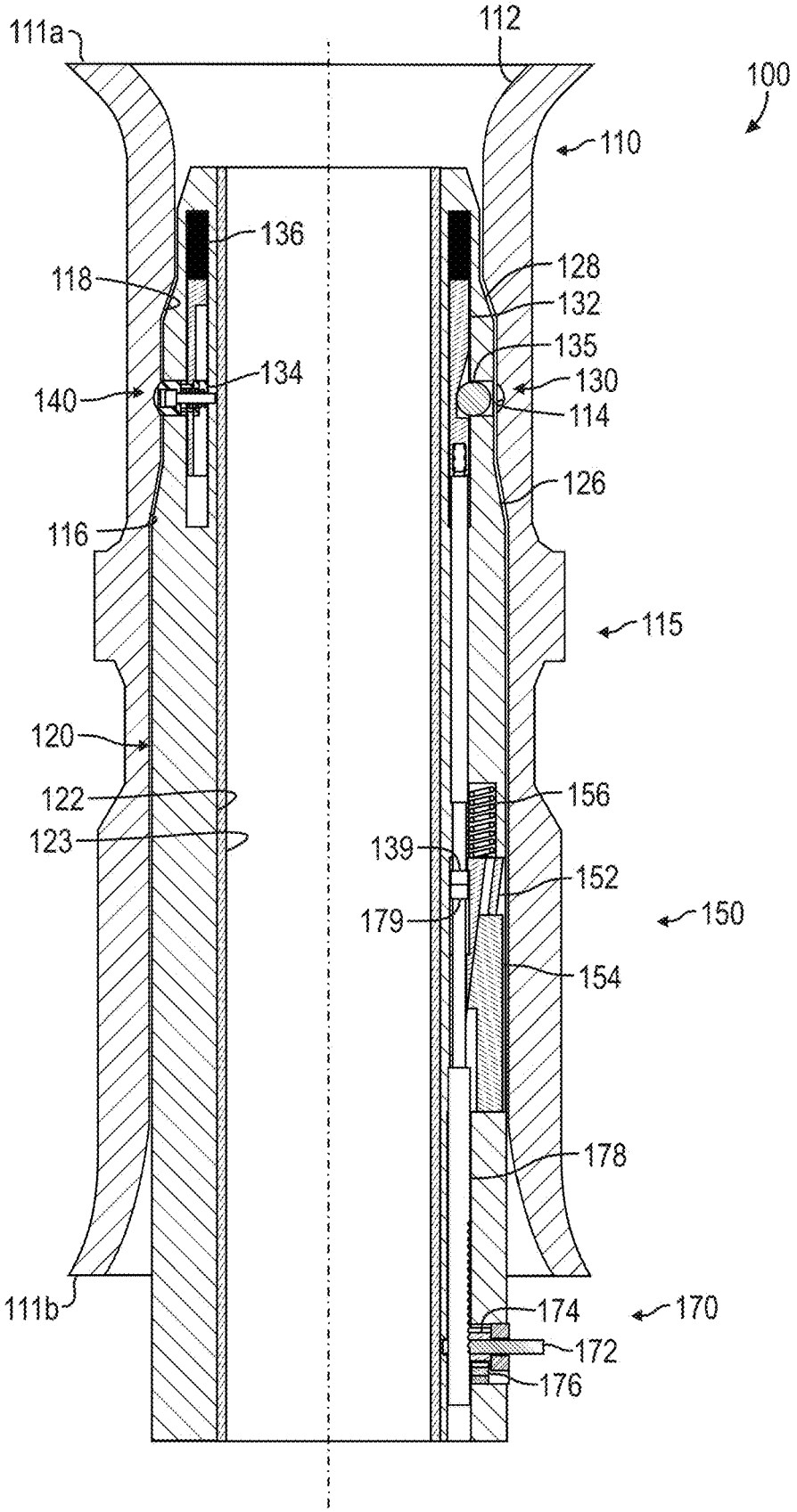
FIG. 7D illustrates a cross-section of the receiver during disconnection of the connector.

At some point during use, the connector 120 may need to be released from the receiver 110 to conduct maintenance, to install new lines, or to achieve any other purpose. To that end, the support assembly 100 allows for disconnection of the receiver 110 and the connector 120. FIG. 7D illustrates a cross-section of the receiver 110 during disconnection of the connector 120. As shown, the lock assembly 170 is movable from the locked condition to a released condition. The lock assembly 170 in the released condition is then configured to move the activation wedge 152 from the active position to the inactive position. Furthermore, the lock assembly 170 in the released condition is also configured to move the sleeve 132 from the second axial position to the first axial position on the connector 120.

In particular, the drive shaft 172 can be rotated in a second direction opposite to the first direction. The pinion gear 174 rotates in reverse with the rotation of the drive shaft 172 in the second direction, and the lock rod 178 is moved axially (upward) from the locked position (as shown in FIG. 7C) to a released position (as shown here) in response to movement of the rack gear 177 by the rotation of the pinion gear 174. The lock rod 178 in the released position engages the retention rod 138 of the latch assembly 130, moves the activation wedge 152 from the active position to the inactive position by engagement of the shoulder 139 with the activation wedge's shoulder 153*a*, and moves the sleeve 132 of the latch assembly from the second axial position to the first axial position. The latch dogs 135 in the first side openings (124*a*) are now unsupported by the sleeve 132 and can disengage from the latch profile 114 in the receiver bore 112.

The lock assembly 170 can be released from the locked condition to the released condition by moving the activation wedge 152 from the active position to the inactive position and moving the sleeve 132 from the second axial position to the first axial position on the connector 120. To release the lock assembly 170, the drive shaft 172 is rotated in a second direction opposite to the first direction. The pinion gear 174 rotates with the rotation of the drive shaft 172 in the second direction. The lock rod 178 having the rack gear 177 engaged with the pinion gear 174 moves axially upward from the locked position to the released position in response to movement of the rack gear 177 by the rotation of the pinion gear 174. The lock rod 178 in the released position engages against the retention rod 138 and pushes it upward. The upward movement of the lock rod 178 moves the activation wedge 152 from the active position to the inactive position and also moves the sleeve 132 from the second axial position to the first axial position. The slanted pocket 133 allows the latch dog 135 to retract from the latch profile 114.

After disconnection, the connector 120 can be removed from the receiver 110, which can be done for any suitable purpose. The support system 100 can then be reconnected when needed. For example, the lock assembly 170 can be reset to an initial condition, such as shown in FIGS. 2, 5C and 7A-7C, to allow for the retention rod 138 to move and to allow the trigger assembly 140 to be set for triggering.

Figure 8A:
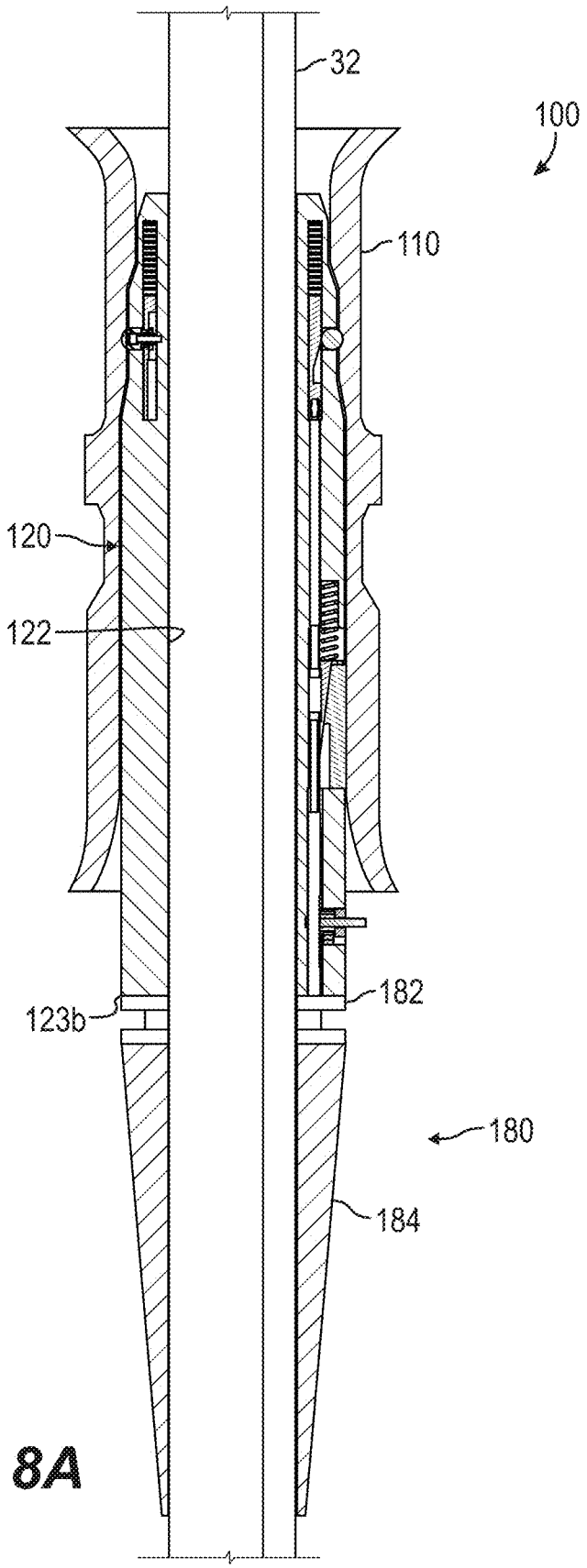
FIG. 8A illustrates a cross-section of a support system, including a receiver having a connector supporting an umbilical or flexible pipe.
Figure 8B:
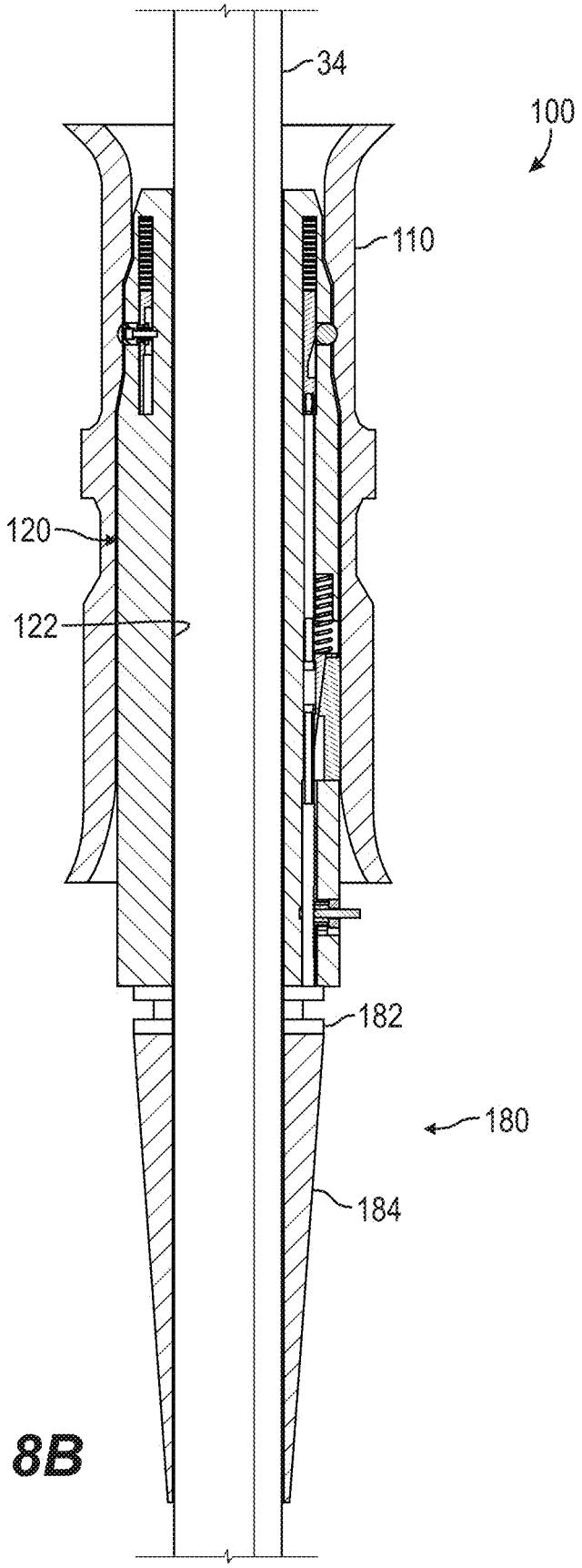
FIG. 8B illustrates a cross-section of a support system, including a receiver having a connector supporting a power cable.
Figure 8C:
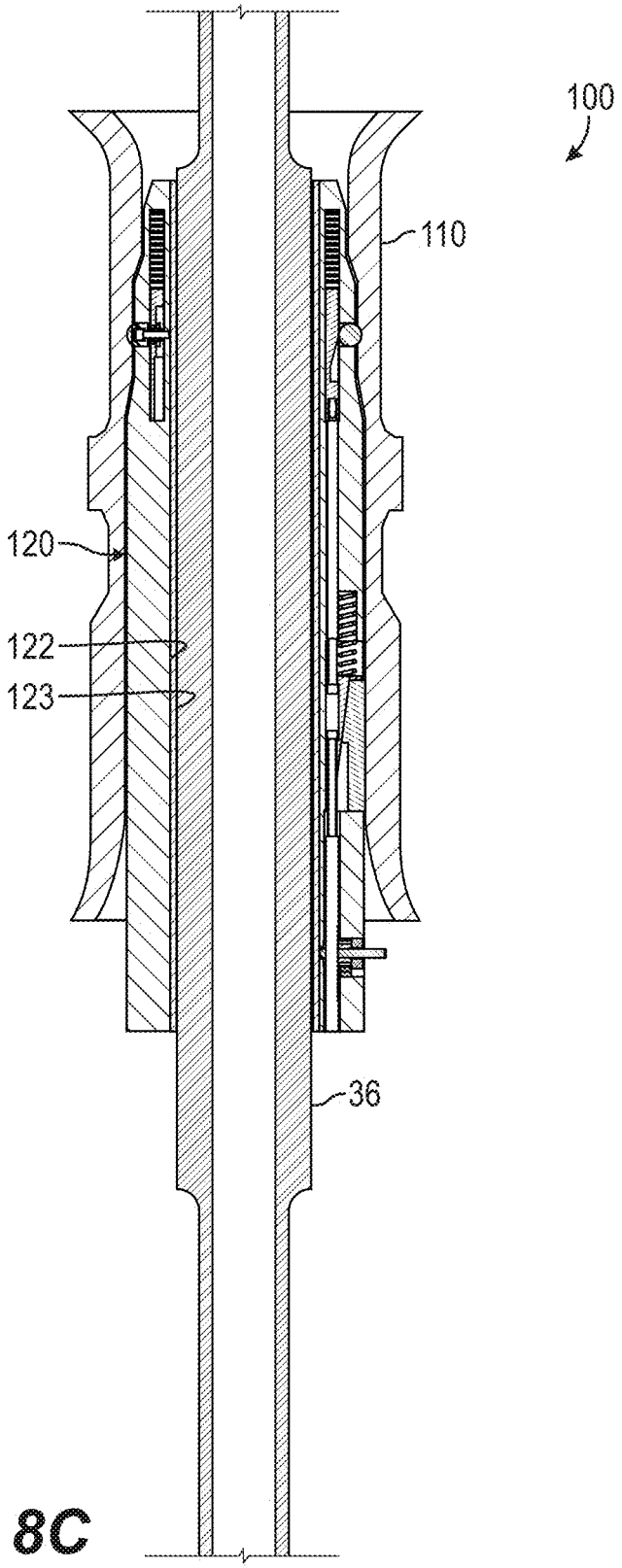
FIG. 8C illustrates a cross-section of a support system, including a receiver having a connector supporting a power cable.

As shown in FIGS. 8A-8C, different types of tubular components can be used with the disclosed support system 100. For example, FIG. 8A illustrates a cross-section of a receiver 110 having a connector 120 supporting an umbilical or a flexible pipe 32, and FIG. 8B illustrates a cross-section of the receiver 110 having a connector 120 supporting a power cable 34. Different diameters of the tubular components can be accommodated by using liners, spacer, or the like in the connector bores 122 or by using connectors 120 having different sized connector bores 122 for particular tubular diameters. Meanwhile, FIG. 8C illustrates a cross-section of the receiver 110 having a connector 120 supporting a rigid tubular 36.

For some of the tubular components, such as the umbilical or the flexible pipe 32 and the power cable 34 of FIGS. 8A-8B, the support system 100 as noted above provides a hang-off interface, which can include a bend stiffener or limiter 180. As shown here, the connector 120 can include a bend limiter 180 extending from the lower end 123*b* of the connector 120 to limit bending of the tubular component (32, 34) extending from the lower end 123*b* of the connector 120. The bend limiter 180 can include a bend stiffener 184 connected by a fixture 182 to the lower end 123*b* of the connector 120.

For rigid tubular components as noted above, the support system 100 provides an interface for hang-off of a riser pipe support with an internal wear surface. As shown in FIG. 8C, for example, the connector 120 fills the gap between the receiver bore 112 and the outside diameter of a rigid tubular 36 after larger sections of a riser (not shown) have passed through the receiver 110. The internal wear sleeve 125 lines the connector bore 122 and can protect coatings and surfaces of the riser.

Figure 9A:
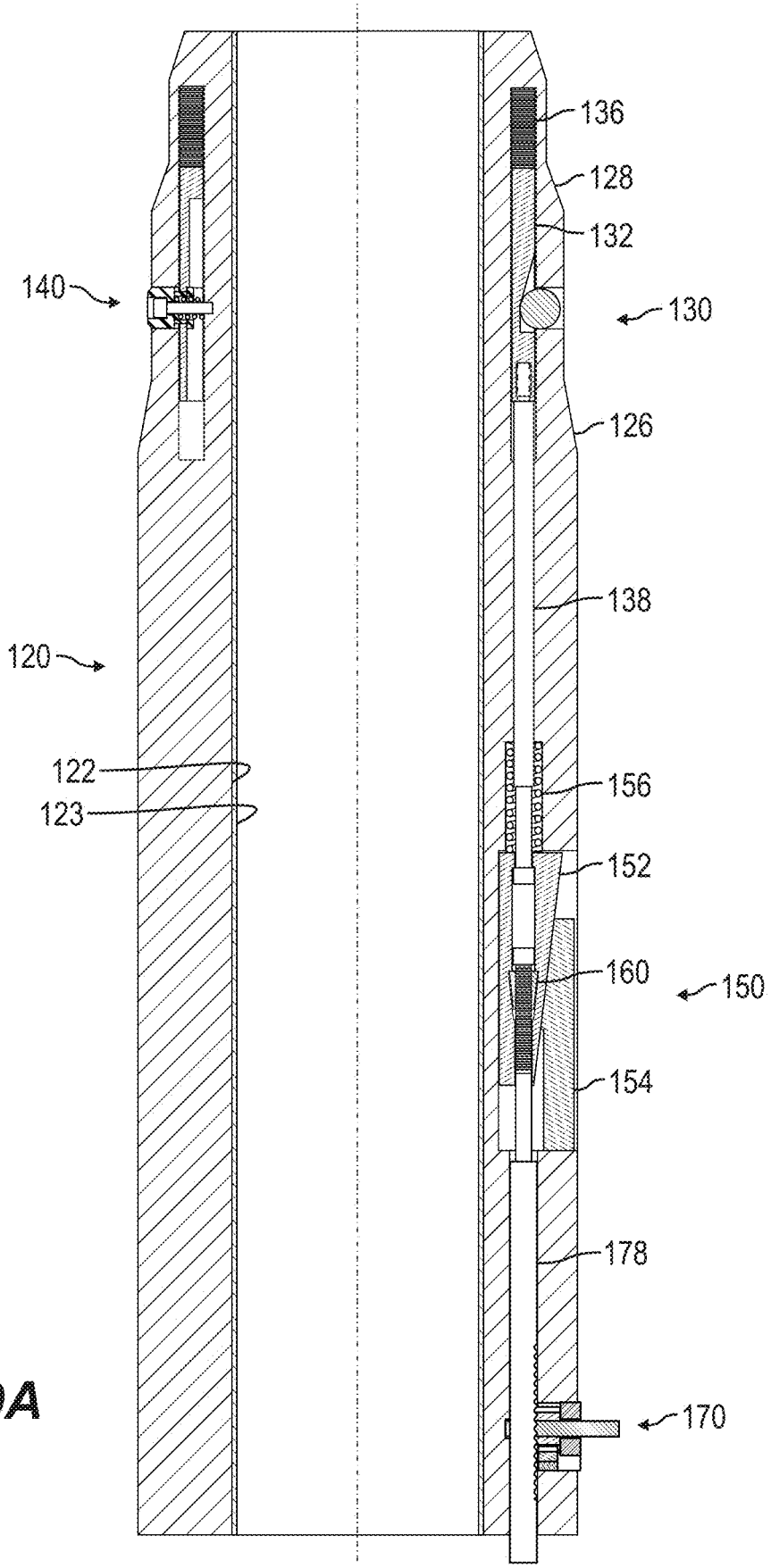
FIG. 9A illustrates a cross-section of another connector for a support system according to the present disclosure.

FIG. 9A illustrates a cross-section of another connector 120 for a support system (100) according to the present disclosure. Details of this connector 120 are similar to those discussed previously so the same reference numerals are used for similar components. The connector 120 has a latch 130, a trigger 140, an anchor 150, and a lock 170—each of which can be an assembly, a mechanism, or the like having one or more components. Each of these is similar to the previous arrangement. As noted above and as shown here, an internal wear sleeve 125 can line the connector bore 122 and can protect any coating or surface on a tubular component (not shown) passed in the connector bore 122.

As before, the latch assembly 130 is operatively coupled to the anchor assembly 150 using the retention rod 138, which is used to hold the activation wedge 152 in the inactive position against the bias of the spring 156. Additionally, the lock assembly 170 is operatively coupled to the anchor assembly 150 using the lock rod 178, which can further move and lock the activation wedge 152 toward the active position beyond the bias force of the spring 156. The connector 120 as before can include a plurality of the features for the latch assembly 130, the trigger assembly 140, the anchor assembly 150, and the lock assembly 170 disposed about the circumference of the body of the connector 120.

The present connector 120 further includes a slip 160, which is used in connection with the anchor and lock assemblies 130, 150. The slip 160 can be an assembly, a mechanism, or the like having one or more components. The slip (e.g., slip assembly) 160 is used between the activation wedge 152 and the lock rod 178. Further details are provided below.

Figure 9B:
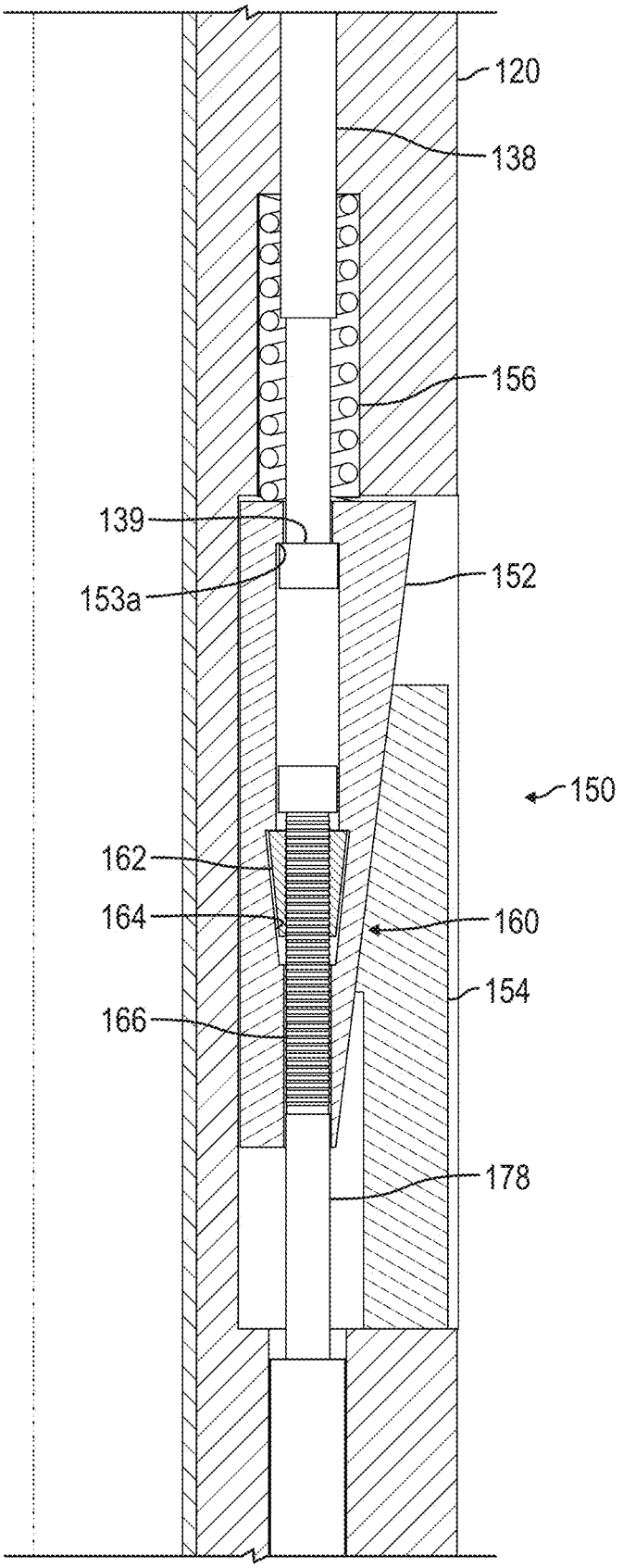
FIG. 9B illustrates a detailed cross-section of a portion of the connector in FIG. 9A.

Turning now to FIG. 9B, the slip assembly 160 includes a plurality of slip elements 162 arranged between the activation wedge 152 and the lock rod 178. The activation wedge 152 defines a cone opening having an inclined surface 164, and the lock rod 178 defines a ratchet surface 166. The slip elements 162 are disposed between the inclined surface 164 and the ratchet surface 166 so the slip elements 162 can fit in the cone opening having the inclined surface 164 and are disposed circumferentially about the ratchet surface 166. The slip elements 162 are configured to grip between the inclined surface 164 and the ratchet surface 166 when the lock rod 178 is moved toward the locked position. By contrast, the slip elements 162 are configured to release between the inclined surface 164 and the ratchet surface 166 when the lock rod 178 is moved toward the unlocked position.

In FIG. 9B, the components are shown in the arrangement for insertion of the connector 120 into the bore (112) of the receiver (110). The shoulder 139 of the retention rod 138 engages the shoulder 153*a* of the activation wedge 152 and holds the activation wedge 152 in the inactive position against the bias of the spring 156. The lock rod 178 is in its unlocked position.

Figure 10A:
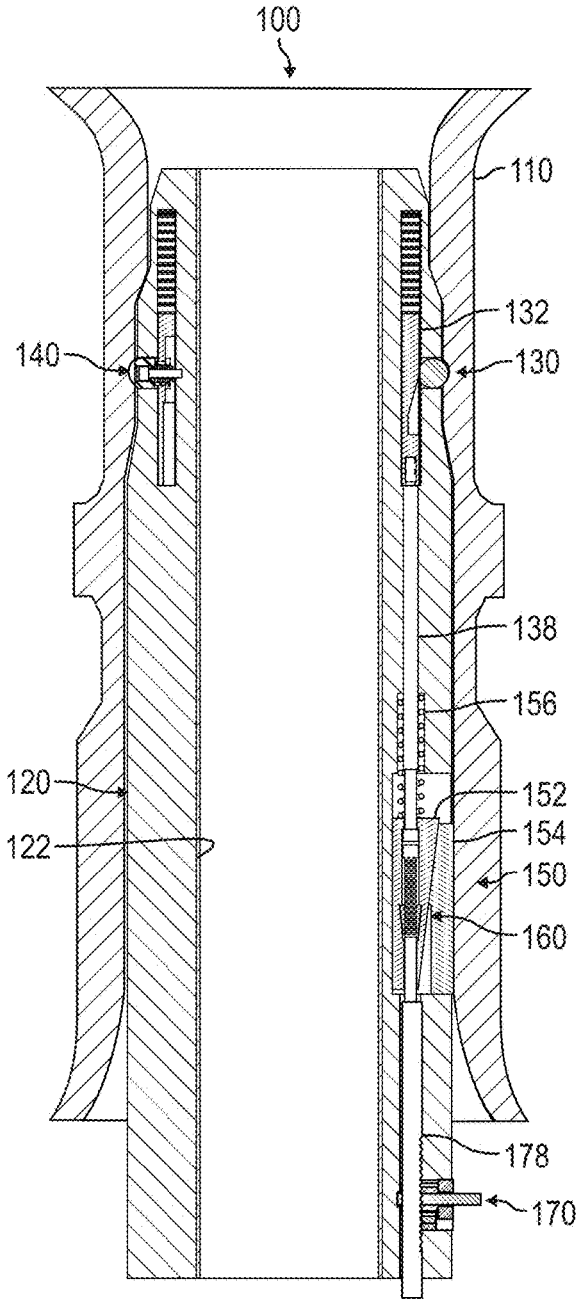
FIG. 10A illustrates a cross-section of the receiver during initial latching of the connector.

Initial latching of the connector 120 in the receiver 110 is shown in FIG. 10A. The trigger assembly 140 is triggered engagement inside the receiver bore 112. In response to the triggering, the connection process involves releasing the latch assembly 130, moving the latch assembly 130 from a retracted condition to an extended condition on the connector 120, and latching the latch assembly 130 in the extended condition. In response to the moving of the latch assembly 130 in the extended condition, the anchor assembly 150 disposed on the connector 120 is anchored against the receiver bore 112. In particular, the release of the sleeve 132 moves the retention rod 138 so the activation wedge 152 can move from the inactive position toward the active position by the bias of the spring 156. The engagement wedge 154 moves laterally from an unwedged position to a wedged position against the surface of the receiver bore 112. During movement of the activation wedge 152, the slip assembly 160 can move along the lock rod 178 with the movement of the activation wedge 152.

Figure 10B:
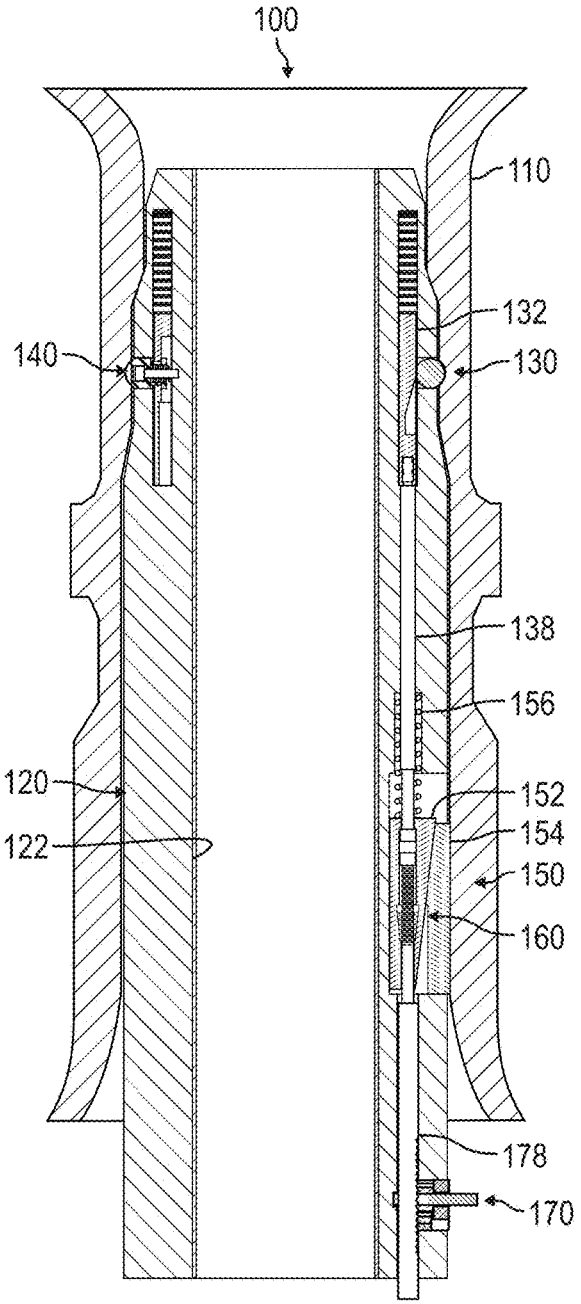
FIG. 10B illustrates a cross-section of the receiver during final latching of the connector.

Final latching of the connector 120 in the receiver 110 is shown in FIG. 10B. In the process, the anchor assembly 150 is locked against the receiver bore 112 by moving the lock assembly 170 disposed on the connector 120 from an unlocked condition to a locked condition. As before, the drive shaft 172 extending from the connector 120 is rotated, which rotates the pinion gear 174 and moves the lock rod 178 having the rack gear 177 engaged with the pinion gear 174 axially from an unlocked position to a locked position. As the lock rod 178 moves, the ratchet engagement between the rod's ratchet surface (166) and the slip elements (162) of the slip assembly 160 pulls the slip elements (162) further into the inclined surface (164) of the cone opening in the activation wedge 152. As a result, the slip elements (162) grip between the rod's ratchet surface (166) and the wedge's inclined surface 164, preventing movement of the activation wedge 152 from the activation position and further locking the engagement wedge 154 engaged in the receiver bore 112.

As noted herein, the anchor assembly 150 includes sets of activation wedges 152 and the engagement wedges 154 disposed about the circumference of the connector 120. As each corresponding engagement wedge 154 moves laterally into engagement with the receiver bore 112 across the annular gap between the connector 120 and the receiver bore 112, each activation wedge 152 can move independently to its respective activation position along the ratchet surface (166) of its respective lock rod 178. The slip assembly 160 of each activation wedge 152 can also move independently along the ratchet surface (166) of the respective lock rod 178 to engage the inclined surface (164). As a result, each slip assembly 160 provides an adjustable engagement point between its respective lock rod 178 and activation wedge 152 so the lock assembly 170 when activated can pull down evenly on each activation wedge 152.

For example, when the connector 120 is installed in the receiver 110, the tubular component 30 (e.g., riser) disposed in the connector 120 will impart side loads on the connector 120. One portion of an annular gap between the connector 120 and the receiver bore 112 may be narrower than another portion. Consequently, as the lock assembly 150 is actuated, the activation wedges 152 disposed about the circumference of the connector 120 work independently of one another. The activation wedges 152 will move different distances along its respective lock rod 178 as the engagement wedges 154 fill the respective annular gaps to the receiver bore 112. The distance that each activation wedge 152 moves will be dictated by the respective annular gap that the corresponding engagement wedge 154 moves from the connector 120 to the receiver bore 112. The ability of each activation wedge 152 and slip assembly (160) to slide down the rachet surface (166) of the respective lock rod 178 allows the lock assembly 170 to pull down evenly on each activation wedge 152, regardless of its engagement and elevation. This allows the engagement wedges 154 to fill their respective annular gap without needing first to strictly centralize the connector 120 in the receiver 110, which may not be possible due to the side loads imparted by the tubular component (not shown) on the connector 120.

The other lock assembly 170 of the previous arrangements can also work independently of one another to some extent, by providing additional drive pins and separate geared arrangements for the lock rods 178.

Figure 10C:
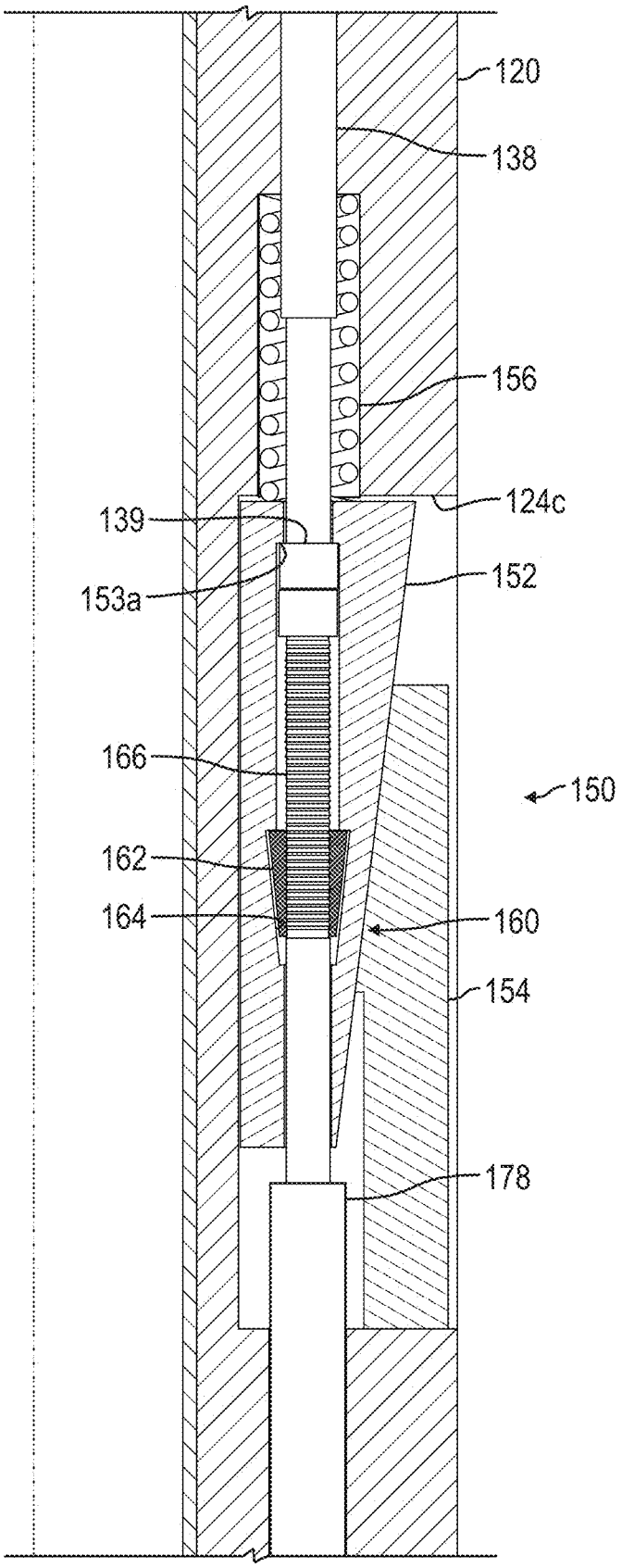
FIG. 10C illustrates a detailed cross-section of the receiver during disconnection of the connector.

Disconnection of the connector 120 from the receiver 110 can be achieved as shown in the detail of FIG. 10C. As before, the drive shaft (172) can be rotated in an opposite direction so the pinion gear (174) rotates and moves the lock rod 178 axially from the locked position to a released position. As the lock rod 178 moves, the ratcheting between the ratchet surface 166 and the slip elements 162 releases the gripping of the slip elements 162. The lock rod 178 in the released position engages the retention rod 138, moves the activation wedge 152 from the active position to the inactive position by engagement of the shoulder 139 with the activation wedge's shoulder 153*a*, and moves the sleeve (132) from the second axial position to the first axial position.

After disconnection, the connector 120 can be removed from the receiver 110, which can be done for any suitable purpose. The support system 100 can then be reconnected when needed. For example, the lock assembly 170 can be reset to an initial condition, such as shown in FIGS. 9A-9B and 10A-10B, to allow for the retention rod 138 to move and to allow the trigger assembly 140 to be set for triggering.

The foregoing description of preferred and other embodiments is not intended to limit or restrict the scope or applicability of the inventive concepts conceived of by the Applicants. It will be appreciated with the benefit of the present disclosure that features described above in accordance with any configuration or aspect of the disclosed subject matter can be utilized, either alone or in combination, with any other described feature, in any other configuration or aspect of the disclosed subject matter.

In exchange for disclosing the inventive concepts contained herein, the Applicants desire all patent rights afforded by the appended claims. Therefore, it is intended that the appended claims include all modifications and alterations to the full extent that they come within the scope of the following claims or the equivalents thereof.

The invention claimed is:

1. A system to support a tubular component used to communicate between a vessel and a subsea environment, the system comprising:

a receiver configured to be supported on the vessel, the receiver defining a receiver bore therethrough, the receiver bore defining an engagement shoulder and defining a latch profile therein; and a connector disposed on the tubular component and being insertable in the receiver bore, the connector having:

a latch disposed on the connector and being mechanically movable with a first mechanical movement at least from a retracted condition to an extended condition on the connector, the latch in the extended condition being configured to latch in the latch profile in the receiver bore;

a trigger disposed on the connector and being operatively coupled to the latch, the trigger being mechanically triggered in response to engagement with the engagement shoulder in the receiver bore, the trigger being configured to initiate the first mechanical movement of the latch from the retracted condition to the extended condition;

an anchor disposed on the connector and being operatively coupled to the latch, the anchor being configured to mechanically engage against the receiver bore in response to the first mechanical movement of the latch to the extended condition; and a lock disposed on the connector, the lock being operatively coupled to the anchor and being mechanically movable with a second mechanical movement at least from an unlocked condition to a locked condition, the lock in the locked condition being configured to lock the anchor against the receiver bore.

2. The system of claim 1, wherein the connector further comprises a slip disposed on the connector between the lock and the anchor, the slip being configured to grip between the lock and the anchor in response to the lock being in the locked condition.

3. The system of claim 1, wherein the connector defines a first side opening; and wherein the latch comprises:

a sleeve being axially moveable at least from a first axial position to a second axial position on the connector;

a first biasing element biasing the sleeve from the first axial position toward the second axial position; and at least one dog disposed in the first side opening of the connector and being laterally moveable at least from a retracted position in conjunction with the sleeve in the first axial position to an extended position in conjunction with the sleeve in the second axial position.

4. The system of claim 3, wherein the at least one dog comprises a plurality of bearings disposed in respective ones of the first side opening of the connector arranged about a circumference of the connector.

5. The system of claim 3, wherein the connector defines a second side opening; and wherein the trigger comprises a pin disposed in the second side opening of the connector and being biased from a released condition to an engaged condition, the pin in the engaged condition being engaged with the sleeve of the latch and holding the latch in the first axial position, the pin in the engaged condition being configured to engage the engagement shoulder of the receiver bore and being moveable to the released condition, the pin in the released condition releasing the sleeve to move toward the second axial position.

6. The system of claim 3, wherein the connector defines a third side opening; and wherein the anchor comprises:

an activation wedge being axially moveable at least from an inactive position to an active position on the connector;

a second biasing element biasing the activation wedge from the inactive position toward the active position; and an engagement wedge disposed in the third side opening of the connector and being laterally moveable from an unwedged position to a wedged position, the engagement wedge having the unwedged position in response to the activation wedge in the inactive position, the engagement wedge having the wedged position in response to the activation wedge in the active position, the engagement wedge in the wedged position being configured to engage against the receiver bore.

7. The system of claim 6, wherein the latch comprises a retention rod extending from the sleeve and being moveable axially with the movement of the sleeve from the first axial position to the second axial position, the retention rod with the sleeve in the first axial position holding the activation wedge in the inactive position, the retention rod with the sleeve in the second axial position releasing the activation wedge to move to the active position.

8. The system of claim 6, wherein the lock in the locked condition is configured to lock the activation wedge in the active position.

9. The system of claim 8, wherein the lock is movable from the locked condition to a released condition, the lock in the released condition being configured to move the activation wedge from the active position to the inactive position, the lock in the released condition being configured to move the sleeve from the second axial position to the first axial position on the connector.

10. The system of claim 8, wherein the lock comprises:

a drive shaft extending from the connector and being rotatable in a first direction;

a pinion gear being rotatable with the rotation of the drive shaft in the first direction; and a lock rod having a rack gear engaged with the pinion gear, the lock rod being axially moveable between an unlocked position and a locked position in response to the rotation of the rack gear in the first direction, the lock rod in the unlocked position permitting movement of the activation wedge from the activation position, the lock rod in the locked position preventing movement of the activation wedge from the activation position.

11. The system of claim 10, wherein the activation wedge defines a first lock surface; and wherein the lock rod defines a second lock surface, the second lock surface on the lock rod in the unlocked position being disengaged from the first lock surface of the activation wedge, the second lock surface on the lock rod in the locked position being engaged with the first lock surface of the activation wedge.

12. The system of claim 11, wherein the anchor comprises a plurality of the activation wedge and the engagement wedge disposed about a circumference of the connector; and wherein the lock comprises:

a circumferential gear rack disposed on the connector and being engaged with the pinion gear, the circumferential gear rack being rotatable about the circumference of the connector;

a plurality of second pinion gears engaged with the circumferential gear rack and being rotatable thereby; and a plurality of second lock rods each having a second rack gear engaged with a respective one of the second pinion gears, each second lock rod being axially moveable between the unlocked position and the locked position in response to movement of the rack gear by the rotation of the respective second pinion gear, each second lock rod in the unlocked position having the first lock surface disengaged from the second lock surface of a respective one of the activation wedges, each second lock rod in the locked position having the first lock surface engaged with the second lock surface of the respective activation wedge and preventing movement of the respective activation wedge from the activation position.

13. The system of claim 10, wherein the activation wedge defines an inclined surface; wherein the lock rod defines a ratchet surface; and wherein the lock comprises a slip disposed between the inclined surface and the ratchet surface, the slip being configured to grip between the inclined surface and the ratchet surface in response to the lock rod moved toward the locked position, the slip being configured to release between the inclined surface and the ratchet surface in response to the lock rod moved toward the unlocked position.

14. The system of claim 13, wherein the anchor comprises sets of the activation wedge and the engagement wedge disposed about a circumference of the connector, each activation wedge being movable independently to the activation position along the ratchet surface of the respective lock rod and moving the respective engagement wedge laterally into engagement with the receiver bore across a respective annular gap between the connector and the receiver bore, the slip of each activation wedge being movable independently along the ratchet surface of the respective lock rod to engage the inclined surface and being configured to provide an adjustable engagement point between the lock rod and the activation wedge such that the lock is configured to pull down evenly on each activation wedge.

15. The system of claim 10, wherein the lock is movable from the locked condition to a released condition, the lock in the released condition being configured to move the activation wedge from the active position to the inactive position, the lock in the released condition being configured to move the sleeve from the second axial position to the first axial position on the connector; and wherein:

the drive shaft is rotatable in a second direction opposite to the first direction;

the pinion gear is rotatable with the rotation of the drive shaft in the second direction; and the lock rod having the rack gear engaged with the pinion gear is axially moveable between the locked position to a release position in response to movement of the rack gear by the rotation of the pinion gear in the second direction, the lock rod in the released position being configured to engage a retention rod of the latch, move the activation wedge from the active position to the inactive position, and move the sleeve from the second axial position to the first axial position.

16. A vessel for which a tubular component is used to communicate between the vessel and a subsea environment, the vessel comprising:

a balcony extending from a side of the vessel; and a system according to claim 1, the system having the receiver supported on the balcony of the vessel and having the connector disposed on the tubular component.

17. A method used for a vessel, the method comprising:

passing a tubular component through a receiver bore of a receiver supported on the vessel;

inserting a connector disposed on the tubular component into the receiver bore;

mechanically triggering a trigger disposed on the connector in response to engagement of the trigger with an engagement shoulder defined in the receiver bore;

mechanically releasing a latch, in response to the mechanical triggering of the trigger, from a retracted condition to an extended condition on the connector, and latching the latch in the extended condition against a latch profile defined in the receiver bore; and mechanically anchoring an anchor disposed on the connector against the receiver bore in response to the mechanical release of the latch; and locking the anchor against the receiver bore by mechanically moving a lock disposed on the connector from an unlocked condition to a locked condition.

18. The method of claim 17, further comprising gripping a slip between the lock and the anchor in response to the lock being in the locked condition.

19. The method of claim 17, wherein mechanically releasing and latching the latch comprises:

moving a sleeve axially from a first axial position to a second axial position on the connector by biasing the sleeve with a first biasing element;

moving at least one dog disposed in a first side opening of the connector laterally from a retracted position in conjunction with the sleeve in the first axial position to an extended position in conjunction with the sleeve in the second axial position; and engaging the at least one dog in the latch profile defined in the receiver bore.

20. The method of claim 19, wherein mechanically triggering the trigger comprises:

holding the latch in the first axial position by biasing a pin of the trigger disposed in a second side opening of the connector to an engaged condition, the pin in the engaged condition being engaged with the sleeve of the latch; and releasing the sleeve to move toward the second axial position by engaging the pin in the engaged condition against the engagement shoulder defined in the receiver bore and moving the pin from the engaged condition to a released condition.

21. The method of claim 19, wherein mechanically anchoring the anchor comprises:

holding an activation wedge of the anchor in an inactive position biased toward an active position on the connector;

releasing, in response to the sleeve moving toward the second axial position, the activation wedge to move from the inactive position toward the active position; and wedging an engagement wedge of the anchor disposed in a second side opening of the connector by moving the engagement wedge laterally from an unwedged position in conjunction with the activation wedge in the inactive position to a wedged position in conjunction with the activation wedge in the active position.

22. A system to support a tubular component used to communicate between a vessel and a subsea environment, the system comprising:

a receiver configured to be supported on the vessel, the receiver defining a receiver bore therethrough, the receiver bore defining an engagement shoulder and defining a latch profile therein; and a connector disposed on the tubular component and being insertable in the receiver bore, the connector defining a first side opening and a second side opening, the connector having:

a latch disposed on the connector and being mechanically movable with a first mechanical movement, the latch comprising a sleeve, a first biasing element, and at least one dog, the sleeve being axially moveable at least from a first axial position to a second axial position on the connector, the first biasing element biasing the sleeve from the first axial position toward the second axial position, the at least one dog disposed in the first side opening of the connector and being laterally moveable at least from a retracted position in conjunction with the sleeve in the first axial position to an extended position in conjunction with the sleeve in the second axial position;

a trigger disposed on the connector and being operatively coupled to the latch, the trigger being mechanically triggered in response to engagement with the engagement shoulder in the receiver bore, the trigger being configured to initiate the first mechanical movement of the latch; and an anchor disposed on the connector and being operatively coupled to the latch, the anchor being configured to mechanically engage against the receiver bore in response to the first mechanical movement of the latch, the anchor comprising an activation wedge, a second biasing element, and an engagement wedge, the activation wedge being axially moveable at least from an inactive position to an active position on the connector, the second biasing element biasing the activation wedge from the inactive position toward the active position, the engagement wedge disposed in the second side opening of the connector and being laterally moveable from an unwedged position to a wedged position, the engagement wedge having the unwedged position in response to the activation wedge in the inactive position, the engagement wedge having the wedged position in response to the activation wedge in the active position, the engagement wedge in the wedged position being configured to engage against the receiver bore.

23. The system of claim 22, wherein the latch comprises a retention rod extending from the sleeve and being moveable axially with the movement of the sleeve from the first axial position to the second axial position, the retention rod with the sleeve in the first axial position holding the activation wedge in the inactive position, the retention rod with the sleeve in the second axial position releasing the activation wedge to move to the active position.

24. The system of claim 22, wherein the connector further comprises a lock disposed on the connector, the lock being operatively coupled to the anchor and being movable at least from an unlocked condition to a locked condition, the lock in the locked condition being configured to lock the activation wedge in the active position.

25. The system of claim 24, wherein the lock is movable from the locked condition to a released condition, the lock in the released condition being configured to move the activation wedge from the active position to the inactive position, the lock in the released condition being configured to move the sleeve from the second axial position to the first axial position on the connector.

26. The system of claim 24, wherein the lock comprises:

a drive shaft extending from the connector and being rotatable in a first direction;

a pinion gear being rotatable with the rotation of the drive shaft in the first direction; and a lock rod having a rack gear engaged with the pinion gear, the lock rod being axially moveable between an unlocked position and a locked position in response to the rotation of the rack gear in the first direction, the lock rod in the unlocked position permitting movement of the activation wedge from the activation position, the lock rod in the locked position preventing movement of the activation wedge from the activation position.

27. The system of claim 26, wherein the activation wedge defines a first lock surface; and wherein the lock rod defines a second lock surface, the second lock surface on the lock rod in the unlocked position being disengaged from the first lock surface of the activation wedge, the second lock surface on the lock rod in the locked position being engaged with the first lock surface of the activation wedge.

28. The system of claim 27, wherein the anchor comprises a plurality of the activation wedge and the engagement wedge disposed about a circumference of the connector; and wherein the lock comprises:

a circumferential gear rack disposed on the connector and being engaged with the pinion gear, the circumferential gear rack being rotatable about the circumference of the connector;

a plurality of second pinion gears engaged with the circumferential gear rack and being rotatable thereby; and a plurality of second lock rods each having a second rack gear engaged with a respective one of the second pinion gears, each second lock rod being axially moveable between the unlocked position and the locked position in response to movement of the rack gear by the rotation of the respective second pinion gear, each second lock rod in the unlocked position having the first lock surface disengaged from the second lock surface of a respective one of the activation wedges, each second lock rod in the locked position having the first lock surface engaged with the second lock surface of the respective activation wedge and preventing movement of the respective activation wedge from the activation position.

29. The system of claim 26, wherein the activation wedge defines an inclined surface; wherein the lock rod defines a ratchet surface; and wherein the lock comprises a slip disposed between the inclined surface and the ratchet surface, the slip being configured to grip between the inclined surface and the ratchet surface in response to the lock rod moved toward the locked position, the slip being configured to release between the inclined surface and the ratchet surface in response to the lock rod moved toward the unlocked position.

30. The system of claim 29, wherein the anchor comprises sets of the activation wedge and the engagement wedge disposed about a circumference of the connector, each activation wedge being movable independently to the activation position along the ratchet surface of the respective lock rod and moving the respective engagement wedge laterally into engagement with the receiver bore across a respective annular gap between the connector and the receiver bore, the slip of each activation wedge being movable independently along the ratchet surface of the respective lock rod to engage the inclined surface and being configured to provide an adjustable engagement point between the lock rod and the activation wedge such that the lock is configured to pull down evenly on each activation wedge.

31. The system of claim 26, wherein the lock is movable from the locked condition to a released condition, the lock in the released condition being configured to move the activation wedge from the active position to the inactive position, the lock in the released condition being configured to move the sleeve from the second axial position to the first axial position on the connector; and wherein:

the drive shaft is rotatable in a second direction opposite to the first direction;

the pinion gear is rotatable with the rotation of the drive shaft in the second direction; and the lock rod having the rack gear engaged with the pinion gear is axially moveable between the locked position to a release position in response to movement of the rack gear by the rotation of the pinion gear in the second direction, the lock rod in the released position being configured to engage a retention rod of the latch, move the activation wedge from the active position to the inactive position, and move the sleeve from the second axial position to the first axial position.

32. A vessel for which a tubular component is used to communicate between the vessel and a subsea environment, the vessel comprising:

a balcony extending from a side of the vessel; and a system according to claim 22, the system having the receiver supported on the balcony of the vessel and having the connector disposed on the tubular component.

33. A method used for a vessel, the method comprising:

passing a tubular component through a receiver bore of a receiver supported on the vessel;

inserting a connector disposed on the tubular component into the receiver bore;

mechanically triggering a trigger disposed on the connector in response to engagement of the trigger with an engagement shoulder defined in the receiver bore, wherein mechanically triggering the trigger comprises: holding a sleeve of a latch in a first axial position by biasing a pin of the trigger disposed in a first side opening of the connector to an engaged condition, the pin in the engaged condition being engaged with the sleeve of the latch; and releasing the sleeve to move toward a second axial position by engaging the pin in the engaged condition against the engagement shoulder defined in the receiver bore and moving the pin from the engaged condition to a released condition;

mechanically releasing the latch, in response to the mechanical triggering of the trigger, from a retracted condition to an extended condition on the connector, and latching the latch in the extended condition against a latch profile defined in the receiver bore, wherein mechanically releasing and latching the latch comprises:

moving the sleeve axially from the first axial position to the second axial position on the connector by biasing the sleeve with a biasing element;

moving at least one dog disposed in a second side opening of the connector laterally from a retracted position in conjunction with the sleeve in the first axial position to an extended position in conjunction with the sleeve in the second axial position; and engaging the at least one dog in the latch profile defined in the receiver bore; and mechanically anchoring an anchor disposed on the connector against the receiver bore in response to the mechanical release of the latch.

34. A method used for a vessel, the method comprising:

passing a tubular component through a receiver bore of a receiver supported on the vessel;

inserting a connector disposed on the tubular component into the receiver bore;

mechanically triggering a trigger disposed on the connector in response to engagement of the trigger with an engagement shoulder defined in the receiver bore;

mechanically releasing a latch, in response to the mechanical triggering of the trigger, from a retracted condition to an extended condition on the connector, and latching the latch in the extended condition against a latch profile defined in the receiver bore, wherein mechanically releasing and latching the latch comprises:

moving a sleeve axially from a first axial position to a second axial position on the connector by biasing the sleeve with a biasing element;

moving at least one dog disposed in a first side opening of the connector laterally from a retracted position in conjunction with the sleeve in the first axial position to an extended position in conjunction with the sleeve in the second axial position; and engaging the at least one dog in the latch profile defined in the receiver bore; and mechanically anchoring an anchor disposed on the connector against the receiver bore in response to the mechanical release of the latch, wherein mechanically anchoring the anchor comprises:

holding an activation wedge of the anchor in an inactive position biased toward an active position on the connector;

releasing, in response to the sleeve of the latch moving toward the second axial position, the activation wedge to move from the inactive position toward the active position; and wedging an engagement wedge of the anchor disposed in a second side opening of the connector by moving the engagement wedge laterally from an unwedged position in conjunction with the activation wedge in the inactive position to a wedged position in conjunction with the activation wedge in the active position.

* * * * *